US010343412B2

(12) United States Patent
Kawate et al.

(10) Patent No.: US 10,343,412 B2
(45) Date of Patent: Jul. 9, 2019

(54) LIQUID CONTAINER

(71) Applicant: SEIKO EPSON CORPORATION, Tokyo (JP)

(72) Inventors: Hiroyuki Kawate, Yamanashi (JP); Hiroyoshi Ozeki, Nagano (JP); Manabu Yamaguchi, Nagano (JP); Takumi Nagashima, Nagano (JP); Yoshiaki Shimizu, Nagano (JP)

(73) Assignee: Seiko Epson Corpoation, Tokyo (JP)

( * ) Notice: Subject to any disclaimer, the term of this patent is extended or adjusted under 35 U.S.C. 154(b) by 0 days.

(21) Appl. No.: 15/730,895

(22) Filed: Oct. 12, 2017

(65) Prior Publication Data

US 2018/0104955 A1 Apr. 19, 2018

(30) Foreign Application Priority Data

Oct. 17, 2016 (JP) ..... 2016-203220
Feb. 24, 2017 (JP) ..... 2017-033150

(51) Int. Cl.
*B41J 2/175* (2006.01)
*B41J 29/13* (2006.01)
*B41J 29/02* (2006.01)

(52) U.S. Cl.
CPC ..... *B41J 2/17523* (2013.01); *B41J 2/1752* (2013.01); *B41J 2/1753* (2013.01); *B41J 2/17513* (2013.01); *B41J 2/17553* (2013.01); *B41J 2/17556* (2013.01); *B41J 29/13* (2013.01); *B41J 29/02* (2013.01); *B41J 2002/17516* (2013.01)

(58) Field of Classification Search
CPC ..... B41J 2/17513; B41J 2002/17516; B41J 2/17523
See application file for complete search history.

(56) References Cited

U.S. PATENT DOCUMENTS 4,368,478 A * 1/1983 Koto ..... B41J 2/19 347/86
7,455,396 B2 11/2008 Wakayama
8,136,932 B2 3/2012 Nozawa et al.
9,434,175 B2 9/2016 Nagashima et al.

FOREIGN PATENT DOCUMENTS

JP 2008-087486 A 4/2008
JP 2009-034989 A 2/2009
JP 4519070 B2 8/2010
JP 2015-168247 A 9/2015
JP 2015-174265 A 10/2015

* cited by examiner

*Primary Examiner* — Kristal Feggins
*Assistant Examiner* — Kendrick X Liu

(57) ABSTRACT

The liquid container has a spacer member provided in the liquid storage portion. When three directions orthogonal to each other are assumed to be a D direction, a T direction, and a W direction, in the D direction, a direction from a liquid outlet portion toward the other edge portion of the bag is assumed to be a +D direction, and the opposite direction to the +D direction is assumed to be a −D direction, and a direction in which the dimension of the outer shape of the liquid container is smallest is assumed to be the T direction, and the spacer member has, on the +D direction side, a face inclined such that the dimension in the T direction of the spacer member increases from the +D direction side toward the −D direction side.

14 Claims, 32 Drawing Sheets

LIQUID CONTAINER

CROSS REFERENCE TO RELATED APPLICATIONS

This application claims priority to Japanese Applications No. 2016-203220 filed on October, 2016, and No. 2017-33150 filed on Feb. 24, 2017. The entire disclosures of these Japanese applications are expressly incorporated by reference herein.

BACKGROUND

1. Technical Field

The present invention relates to a liquid container.

2. Related Art

Heretofore, liquid storage bodies for supplying liquid to a liquid ejection apparatus have been widely used. For example, liquid storage bodies disclosed in JP-A-2009-34989, Japanese Patent No. 4519070, JP-A-2015-168247 and JP-A-2008-87486 have a flexible bag, which contains a liquid to be supplied to a liquid ejection apparatus.

JP-A-2009-34989, Japanese Patent No. 4519070, JP-A-2015-168247 and JP-A-2008-87486 are examples of related art.

The flexible bag shrinks as the liquid is consumed. However, depending on the position at which the shrinkage occurs and the state of the shrinkage, there is a possibility that a channel in the bag is blocked, and liquid cannot be sufficiently supplied to the liquid ejection apparatus. In addition, there is a possibility that liquid containing a high concentration of a sedimentary component is supplied to the liquid ejection apparatus after further shrinkage, and there is a risk that the concentration of the liquid that is supplied to the liquid ejection apparatus will become uneven.

SUMMARY

The invention has been made to solve at least some of the above-described issues, and can be realized as the following modes.

(1) According to one mode of the invention, a liquid container for supplying a liquid containing a sedimentary component to liquid ejection apparatus is provided. This liquid container includes a flexible bag in which a liquid storage portion for containing the liquid is provided, and that has one edge portion and the other edge portion opposing the one edge portion; a liquid outlet member that is attached to the one edge portion, and has a liquid outlet portion for leading out the liquid in the liquid storage portion to the liquid ejection apparatus; a liquid outlet tube that has a base end portion connected to the liquid outlet member, and extends in the liquid storage portion from the liquid outlet member toward the other edge portion; and a spacer member provided in the liquid storage portion. When three directions orthogonal to each other are assumed to be a D direction, a T direction, and a W direction, and in the D direction, a direction from the liquid outlet portion toward the other edge portion side of the bag is assumed to be a +D direction, and an opposite direction to the +D direction is assumed to be a −D direction, a direction in which a dimension of an outer shape of the liquid container is smallest is assumed to be the T direction, and a direction orthogonal to the D direction and the T direction is assumed to be the W direction, the spacer member has a portion positioned on the +D direction side relative to the liquid outlet tube, and is provided at a position intersecting a TD plane that includes a central axis of the liquid outlet portion, and lies in the T direction and the D direction, and the spacer member has, on the +D direction side, a face that is inclined such that a dimension along the T direction of the spacer member increases from the +D direction side toward the −D direction side.

With the liquid container of such a mode, the liquid outlet tube is provided in the liquid storage portion provided in the bag, and thus a channel of liquid is secured in the periphery of the liquid outlet tube, and the channel in the bag is unlikely to be blocked. In addition, the end portion on the +D direction side of the liquid outlet tube serves as a virtual supply port for supplying liquid to the liquid ejection apparatus, and the spacer member is positioned on the farther side (the +D direction side) than the end portion on the +D direction side of the liquid outlet tube, and thus the end portion on the +D direction side of the liquid outlet tube and the channel on the even farther side of the end portion on the +D direction side are unlikely to be blocked. Furthermore, the spacer member has the inclined face provided on the farther side (the +D direction side) in a direction in which liquid is suctioned, and thus the bag easily collapses from the far side (the +D direction side) to the front side (the −D direction) in accordance with the shape of the inclined face, and the channel on the farther side of the spacer member is unlikely to be blocked. Therefore, it is possible to reduce the possibility that liquid cannot be sufficiently supplied to the liquid ejection apparatus depending on the shrinkage of the bag. In addition, more highly concentrated liquid can be retained in the liquid storage portion by arranging the spacer member in the liquid storage portion, and thus it is possible to reduce the possibility that the concentration of liquid that is supplied to the liquid ejection apparatus becomes uneven.

(2) In the liquid container of the above-described mode, it may be preferable that the liquid outlet tube is configured to, in an orientation in which the liquid container is mounted in the liquid ejection apparatus, extend from the liquid outlet portion in the liquid storage portion in a horizontal direction, the liquid outlet tube has a first channel portion and a second channel portion, the first channel portion having a first base end portion that is connected to the liquid outlet member and a first leading end portion for introducing the liquid in the liquid storage portion into the first channel portion, and the second channel portion having a second base end portion that is connected to the liquid outlet member and a second leading end portion for introducing the liquid in the liquid storage portion into the second channel portion, and in the orientation, the first leading end portion is positioned above the second leading end portion. With the liquid container of such a mode, liquid having a low concentration and liquid having a high concentration are respectively suctioned at the first channel portion and the second channel portion, the both the liquid having a low concentration and the liquid having a high concentration can be joined at the liquid outlet portion, and supplied to the liquid ejection apparatus, and thus the concentration of liquid that is supplied to the liquid ejection apparatus can be further stabilized.

(3) In the liquid container of the above-described mode, it may be preferable that in the orientation, at least one of a lowermost portion of the spacer member and an uppermost portion of the spacer member is in contact with an internal face of the bag. With the liquid container of such a mode, the bag is likely to shrink along the shape of the inclined face of the spacer member from the contact portion with the spacer member, and thus it is possible to more effectively suppress blocking of the channel in the liquid storage portion.

(4) In the liquid container of the above-described mode, it may be preferable that the spacer member includes a first introduction port for introducing the liquid in the liquid storage portion into the first channel portion and a second introduction port for introducing the liquid in the liquid storage portion into the second channel portion, the first leading end portion is connected to the first introduction port, the second leading end portion is connected to the second introduction port, and in the orientation, both the lowermost portion of the spacer member and the uppermost portion of the spacer member are in contact with the internal face of the bag. With the liquid container of such a mode, the height of the bag can be made constant regardless of the capacity of the bag, and thus the liquid container is inhibited from being mounted to the liquid ejection apparatus at a different inclination depending on each bag. In addition, the spacer member is unlikely to move in the up-down direction, and thus from a state where liquid is not consumed to a state where the amount of liquid became small and the liquid cannot be supplied from the bag, the positions in the up-down direction of the first introduction port and the second introduction port are unlikely to change. As a result, the concentration of liquid that is supplied to the liquid ejection apparatus can be further stabilized.

(5) In the liquid container of the above-described mode, it may be preferable that in the orientation, a center between a height of the lowermost portion of the spacer member and a height of the uppermost portion of the spacer member is the same as a height of a central axis of the liquid outlet portion. With the liquid container of such a mode, the position in the up-down direction of the liquid outlet portion can be stabilized, and thus the liquid outlet portion can be easily connected to the liquid ejection apparatus.

(6) In the liquid container of the above-described mode, it may be preferable that the first leading end portion and the second leading end portion are connected to the spacer member. With the liquid container of such a mode, the positions of the first leading end portion and the second leading end portion, which are virtual supply ports, do not change. In addition, when an impact is applied to the liquid container when the liquid container is carried and dropped or the like, the liquid outlet tube is unlikely to be detached from the spacer member. Therefore, the concentration of liquid that is supplied to the liquid ejection apparatus can be further stabilized.

(7) In the liquid container of the above-described mode, it may be preferable that in the orientation, the first base end portion and the second base end portion are aligned in the horizontal direction, and the first leading end portion and the second leading end portion are aligned in a vertical direction. With the liquid container of such a mode, the first leading end portion and the second leading end portion are unlikely to move in the W direction, and thus liquid can be suctioned at a stable position. In addition, liquid suctioned from the first channel portion and liquid suctioned from the second channel portion are converted from a state of flowing side by side in the vertical direction into a state of flowing side by side in the horizontal direction, and are then mixed with each other, and thus the concentration of liquid that is supplied to the liquid ejection apparatus can be further stabilized.

(8) In the liquid container of the above-described mode, it may be preferable that the spacer member is fixed to the liquid outlet member. With the liquid container of such a mode, the positional relationship between the spacer member and the liquid outlet member can be stabilized, and thus it is possible to reduce the possibility that the concentration of liquid that is supplied to the liquid ejection apparatus varies depending on the individual liquid container.

(9) In the liquid container of the above-described mode, it may be preferable that the spacer member is fixed to the liquid outlet member via a bar-like coupling member. With the liquid container of such a mode, the positional relationship between the spacer member and the liquid outlet member can be further stabilized.

(10) In the liquid container of the above-described mode, it may be preferable that a welded portion is provided on the −D direction side of the bag, the welded portion includes a first welded portion welded to a portion of the liquid outlet member and a second welded portion welded to an end on the −D direction side of the coupling member, and the first welded portion is provided so as to sandwich the second welded portion in the W direction. With such a configuration, the coupling member is unlikely to be detached from the liquid outlet member, and it is possible to suppress peeling off of the welded portion of the bag from the liquid outlet member and the coupling member.

(11) In the liquid container of the above-described mode, it may be preferable that a position of the farthest end on the +D direction side of the first welded portion and a position of the farthest end of the +D direction side of the second welded portion are aligned. With such a configuration, it is possible to more effectively suppress peeling off of the welded portion of the bag from the liquid outlet member and the coupling member.

(12) In the liquid container of the above-described mode, it may be preferable that the spacer member includes a channel for circulating the liquid in a direction intersecting the D direction. With the liquid container of such a mode, it becomes easy to suction the liquid from a direction other than the D direction as well, and thus if the concentration of the liquid differs in a direction other than the D direction, the concentration of the liquid that is supplied to the liquid ejection apparatus can be further stabilized.

(13) In the liquid container of the above-described mode, it may be preferable that the spacer member has a partition portion, and the partition portion is provided at a position between the first leading end portion and the second leading end portion in the T direction. With the liquid container of such a mode, liquid having a low concentration that is on the upper side in the liquid storage portion and liquid having a high concentration that is on the lower side are unlikely to be mixed in the vicinity of the first leading end portion and the second leading end portion. Therefore, it is possible to inhibit the liquid having a high concentration from being unlikely to be suctioned due to the liquid having a low concentration being suctioned from both the first leading end portion and the second leading end portion, and thus the concentration of the liquid that is supplied to the liquid ejection apparatus can be further stabilized.

(14) In the liquid container of the above-described mode, it may be preferable that the liquid outlet tube is configured to extend in a gravity direction from the liquid outlet member toward the inside of the liquid storage portion in the orientation in which the liquid container is mounted in the liquid ejection apparatus, and the spacer member has a portion positioned below the liquid outlet tube in the orientation. With the liquid container of such a mode, liquid contained in the liquid storage portion and having a higher concentration is easily retained in the liquid storage portion using the spacer member. Therefore, the concentration of liquid that is supplied to the liquid ejection apparatus can be further stabilized.

The invention can also be achieved in various modes other than the mode as the above-described liquid container. The invention can be realized in modes such as a liquid ejection apparatus that has a liquid container, a system that has a liquid container and a liquid ejection apparatus, a method for manufacturing a liquid container, and the like.

DESCRIPTION OF EXEMPLARY EMBODIMENTS

A. First Embodiment

Figure 1:
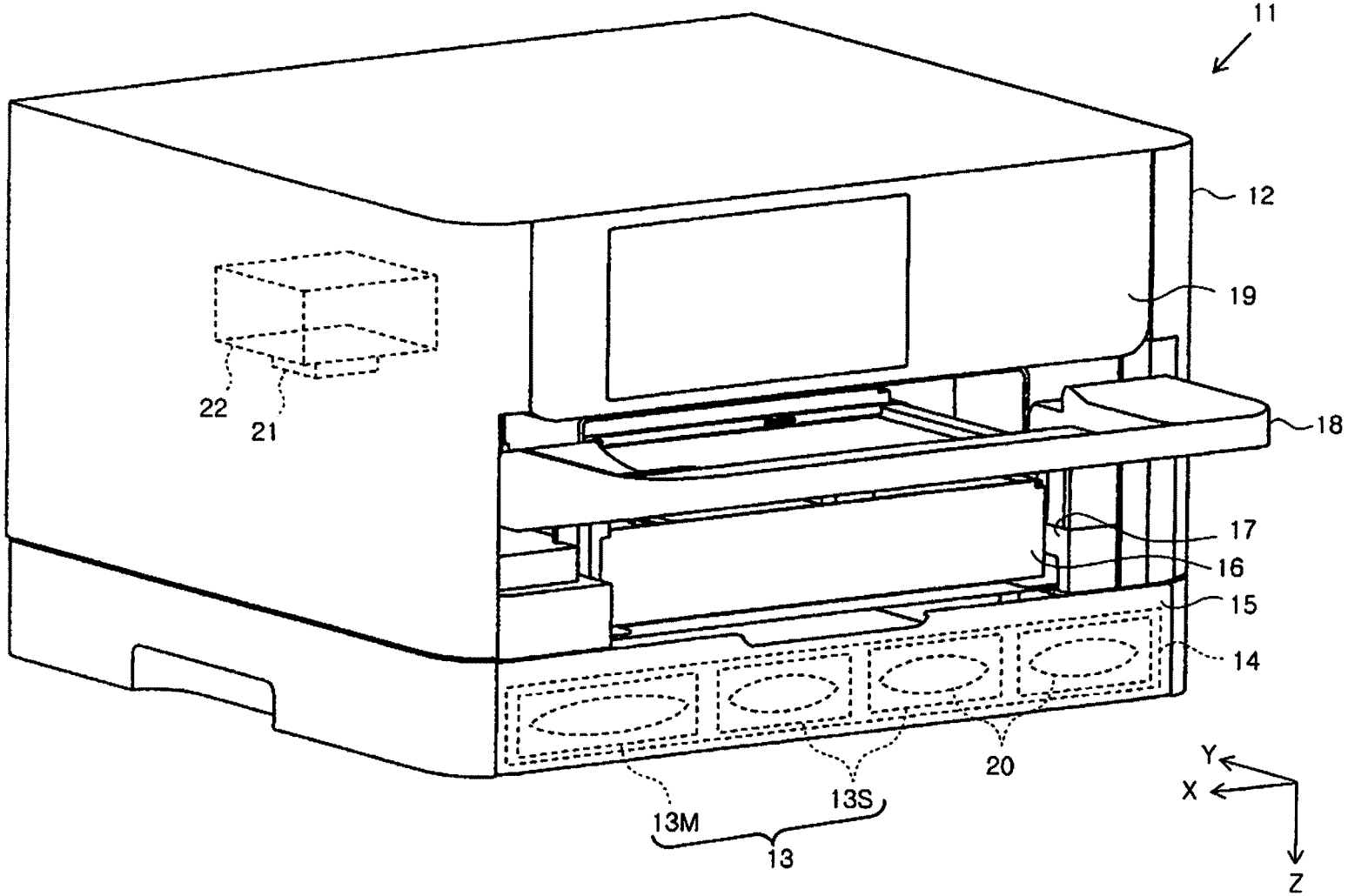
FIG. 1 is a perspective view of a liquid ejection apparatus.

FIG. 1 is a perspective view of a liquid ejection apparatus 11. For example, the liquid ejection apparatus 11 is an inkjet printer that performs recording (printing) by ejecting ink, which is an example of a liquid, onto a medium such as paper. The liquid ejection apparatus 11 is provided with an exterior body 12 having a substantially rectangular parallelepiped shape. In a front face portion of the exterior body 12, a rotatable front lid 15 that covers a mount portion 14 in which a container 13 is detachably mounted and a mount port 17 in which a cassette 16 that can store a medium (not illustrated) is mounted are arranged in the stated order upward from the bottom side. Furthermore, a discharge tray 18 from which a medium is discharged and an operation panel 19 for operating the liquid ejection apparatus 11 are arranged above the mount port 17. Note that the front face of the exterior body 12 refers to a side face that has a height and a width, and in which operations of the liquid ejection apparatus 11 are mainly performed.

A plurality of containers 13 can be mounted in the mount portion 14 of this embodiment in an aspect of being aligned in the width direction. For example, three or more containers 13 including a first container 13S and a second container 13M whose width is longer than the first container 13S are mounted in the mount portion 14, as the plurality of containers 13. In addition, a liquid container 20 is placed removably on each of these containers 13. Specifically, a liquid container 20 is placed on a container 13 that is detachably mounted to the liquid ejection apparatus 11. The container 13 can be detachably mounted to the mount portion 14, even in a single state in which it does not hold a liquid container 20, and is a constituent element that is mounted in the liquid ejection apparatus 11.

A liquid ejection unit 21 that ejects a liquid from a nozzle and a carriage 22 that moves reciprocally along a scanning direction that coincides with the width direction of the liquid ejection apparatus 11 are provided in the exterior body 12. The liquid ejection unit 21 prints on a medium by moving along with the carriage 22, and ejecting, onto this medium, liquid supplied from the liquid container 20 placed on the container 13. Note that in another embodiment, the liquid ejection unit 21 may be a line head whose position is fixed, and that does not move reciprocally.

In this embodiment, a direction intersecting (preferably, orthogonal to) the movement path when the container 13 is mounted to the mount portion 14 is assumed to be the width direction, and a direction in which the movement path extends is assumed to be the depth direction. In addition, the width direction and the depth direction virtually lie along a horizontal plane. In the drawings, assuming that the exterior body 12 is placed on a horizontal plane, the gravity direction is indicated by a Z axis, and the movement direction when the container 13 is mounted to the mount portion 14 is indicated by a Y axis. The movement direction may also be expressed as a mounting direction to the mount portion 14 or an insertion direction into a storage space, and the opposite direction to the movement direction may be expressed as a removal direction. In addition, the width direction is expressed as an X axis orthogonal to the Z axis and the Y axis. Accordingly, the width direction, the gravity direction, and the mounting direction intersect (preferably, are orthogonal to) each other, and are respectively directions when expressing width, height, and depth.

Figure 2:
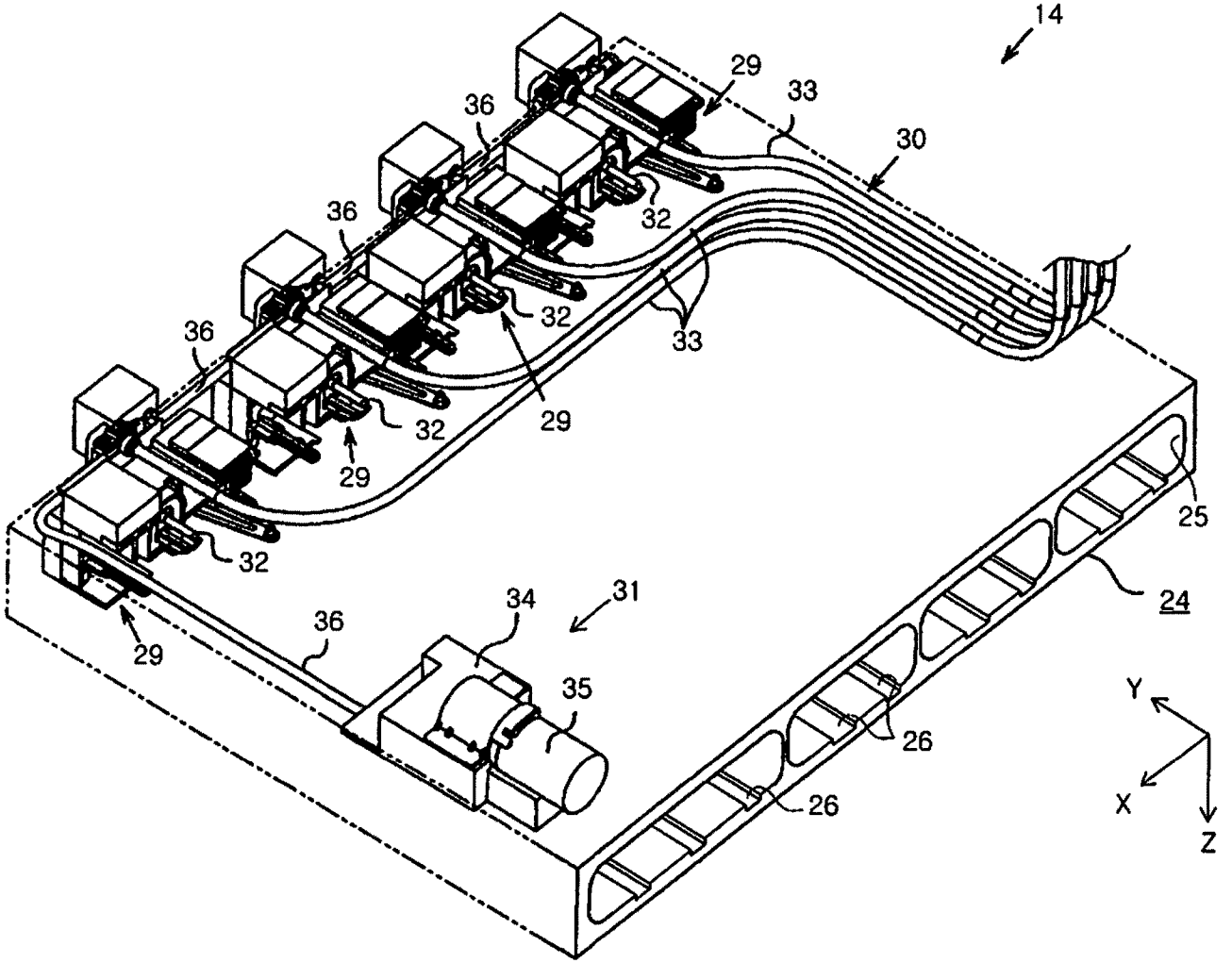
FIG. 2 is a perspective view of a mount portion.

FIG. 2 is a perspective view of the mount portion 14. The mount portion 14 has a frame body 24 that forms a storage space in which one or more (in this embodiment, four) containers 13 can be stored. The frame body 24 forms insertion ports 25 that are in communication with the storage space from the front side, which is the front lid 15 side. Furthermore, the frame body 24 preferably has a plurality of pairs of linear guide rails 26 consisting of one or more projecting shapes or recessed shapes extending in the depth direction in order to guide the movement of the container 13 when mounted or removed.

The container 13 is inserted into the storage space through an insertion port 25, is moved along the movement path extending toward the back, and thereby is mounted to the mount portion 14. Note that in FIG. 2, regarding the frame body 24, only the vicinity of a front plate in which the insertion ports 25 are formed is illustrated with a solid line. On the back side of the storage space, one or more (in this embodiment, four) connection mechanisms 29 are provided in correspondence with the containers 13.

The liquid ejection apparatus 11 is provided with supply channels 30 for supplying a liquid toward the liquid ejection unit 21 from the liquid container 20 that is mounted on the mount portion 14 along with the container 13, and a supply mechanism 31 configured to send liquid contained in the liquid container 20 to the supply channels 30.

The supply channel 30 is provided for each type (in this embodiment, color) of liquid, and includes an ink introduction needle 32 to which the liquid container 20 is connected, and a flexible supply tube 33. A pump chamber (not illustrated) is provided between the ink introduction needle 32 and the supply tube 33. The downstream end of the ink introduction needle 32 and the upstream end of the supply tube 33 are in communication with the pump chamber. The pump chamber is sectioned via a pressure change chamber (not illustrated) and a flexible film (not illustrated).

The supply mechanism 31 is provided with a pressure change mechanism 34, a driving source 35 of the pressure change mechanism 34, and a pressure change channel 36 that connects the pressure change mechanism 34 and the above-described pressure change chambers. In addition, when the pressure change mechanism 34 depressurizes a pressure change chamber through the pressure change channel 36 due to driving of the driving source 35 (e.g., a motor), the flexible film warps and shifts to the pressure change chamber side, and thus the pressure in the pump chamber decreases. Accompanied with this pressure decrease in the pump chamber, liquid contained in the liquid container 20 is suctioned to the pump chamber through the ink introduction needle 32. This is called suction driving. Then, when the pressure change mechanism 34 releases the decompression in the pressure change chamber through the pressure change channel 36, the flexible film warps and shifts to the pump chamber side, and thus the pressure in the pump chamber increases. Accompanied with the increase in the pressure in the pump chamber, the liquid in the pump chamber then flows out to the supply tube 33 in a state of being pressurized. This is called discharge driving. The supply mechanism 31 supplies liquid from the liquid container 20 to the liquid ejection unit 21 by alternately repeating the suction driving and the discharge driving.

Figure 3:
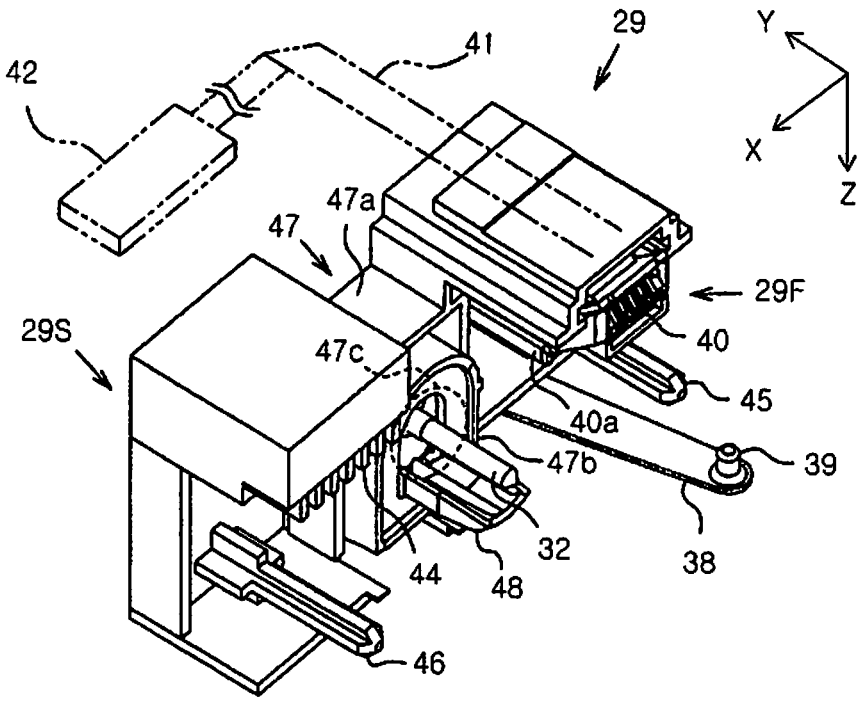
FIG. 3 is a perspective view of a connection mechanism.

FIG. 3 is a perspective view of a connection mechanism 29. The connection mechanism 29 has a first connection mechanism 29F and a second connection mechanism 29S respectively at positions sandwiching the ink introduction needle 32 in the width direction. The first connection mechanism 29F has an arm 38 that is arranged vertically lower than the ink introduction needle 32, and protrudes in the removal direction. An engaging portion 39 is provided at the leading end of the arm 38. The leading end side of the arm 38 is configured to be pivotable around its base end side. The engaging portion 39 is arranged on the movement path of the container 13 when the container 13 is mounted to the mount portion 14 (see FIG. 2) by protruding from the arm 38 vertically upward, for example. The engaging portion 39 is fitted in an engagement groove 78 provided in the rear face of the container 13 when the container 13 is mounted to the mount portion 14, thereby restricting easy detachment of the container 13 from the mount portion 14.

The first connection mechanism 29F is provided with a terminal portion 40 that is arranged higher than the ink introduction needle 32 vertically, and protrudes in the removal direction. The terminal portion 40 is connected to a control apparatus 42 via an electric line 41 such as a flat cable. The terminal portion 40 is preferably arranged such that the upper end of the terminal portion 40 protrudes past the lower end in the removal direction, and is directed obliquely downward. In addition, a pair of guiding projections 40*a* that protrude in the width direction, and extend along the mounting direction are preferably arranged on the two sides of the terminal portion 40 in the width direction.

The second connection mechanism 29S preferably has blocks 44 for preventing erroneous insertion that are arranged higher than the ink introduction needle 32 in the vertical direction, and protrude in the removal direction. The blocks 44 have a recession-and-protrusion-shape arranged to face downward. This recession-and-projection shape is different for each connection mechanism 29.

The connection mechanism 29 is provided with a pair of positioning protrusions 45 and 46, an extrusion mechanism 47 arranged so as to surround the ink introduction needle 32, and a liquid receiving portion 48 protruding in the removal direction below the ink introduction needle 32. The pair of positioning protrusions 45 and 46 are aligned in the width direction so as to be respectively included in the first connection mechanism 29F and the second connection mechanism 29S, and to sandwich the ink introduction needle 32. The positioning protrusions 45 and 46 can be bar-like protrusions protruding in the removal direction in parallel to each other, for example. The lengths of protrusion in the removal direction of the positioning protrusions 45 and 46 are preferably set longer than the length of protrusion in the removal direction of the ink introduction needle 32.

The extrusion mechanism 47 has a frame member 47*a* surrounding the base end portion of the ink introduction needle 32, a pressing portion 47*b* protruding from the frame member 47*a* in the removal direction, and a biasing portion 47*c* that biases the container 13 in the removal direction via the pressing portion 47*b*. The biasing portion 47*c* can be a coil spring installed between the frame member 47*a* and the pressing portion 47*b*, for example.

Figure 4:
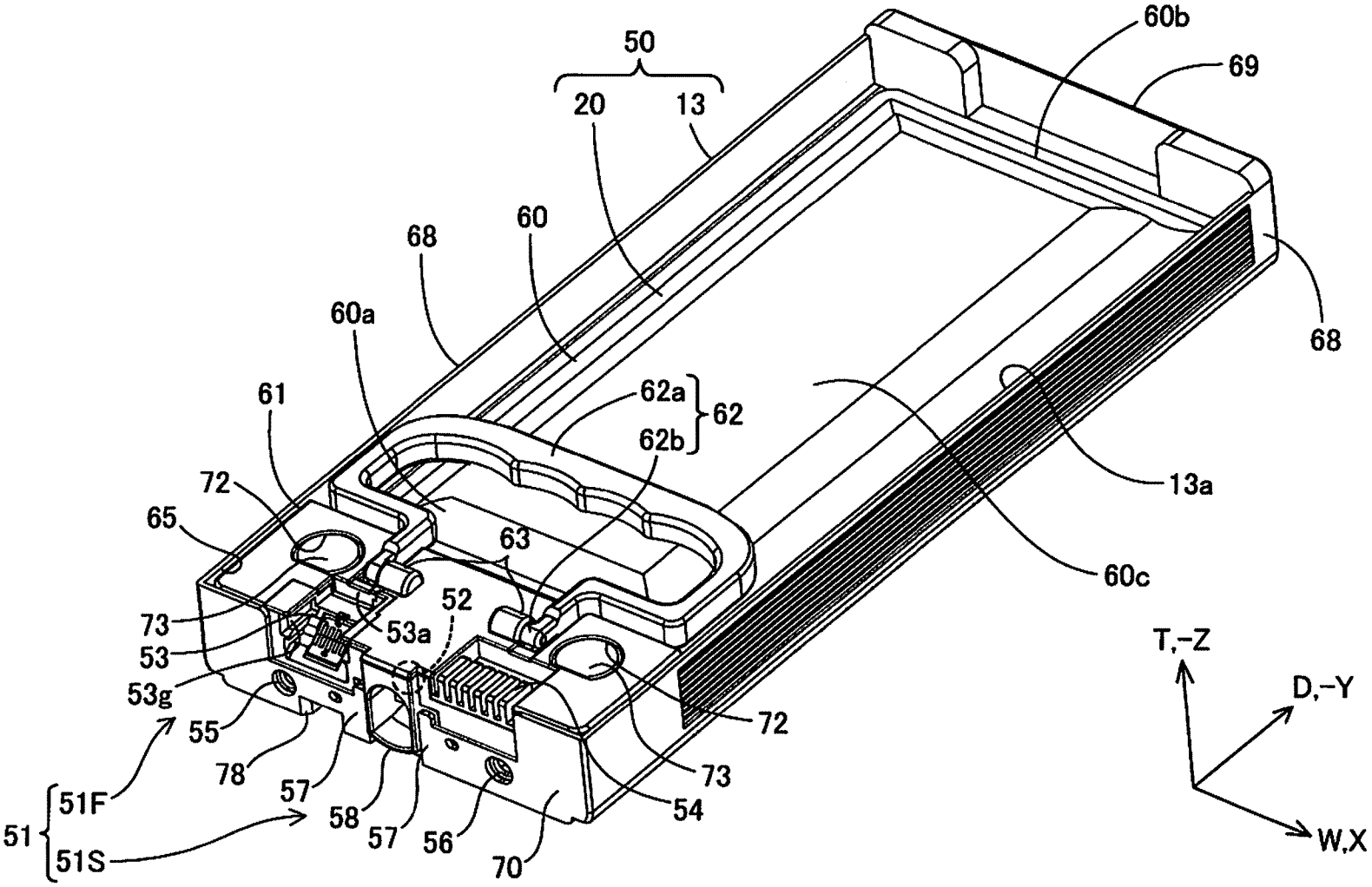
FIG. 4 is a perspective view of a mount body that is mounted to the mount portion.
Figure 5:
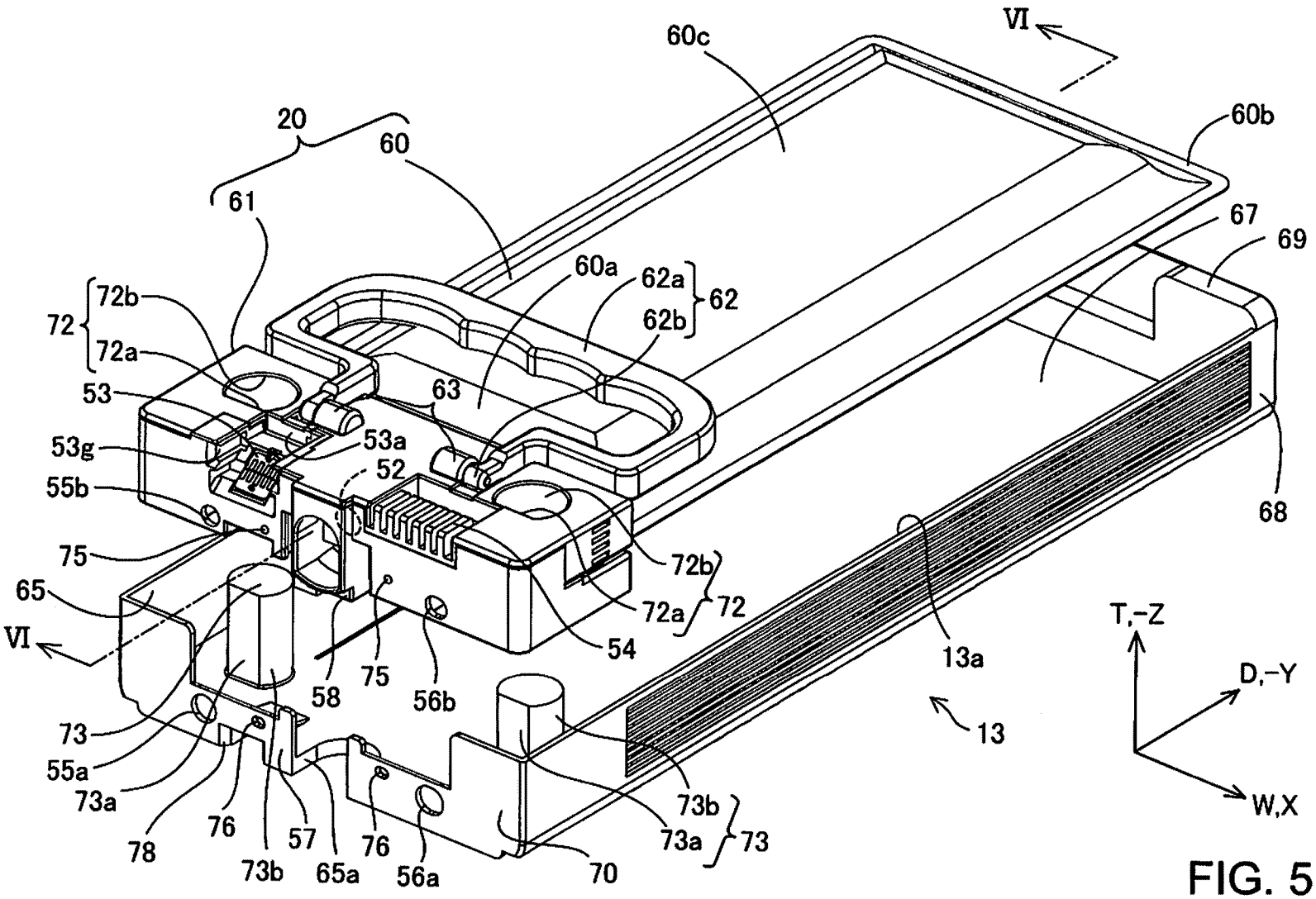
FIG. 5 is perspective view of a liquid container and a container constituting the mount body.

FIG. 4 is a perspective view of a mount body 50 that is mounted to the mount portion 14. In this embodiment, the mount body 50 is constituted by the container 13 whose outer shape is substantially rectangular parallelepiped, and the liquid container 20 that is placed on the container 13. FIG. 4 and FIG. 5 that will be described later show a perspective view of the second container 13M as the container 13.

The liquid container 20 is a container for supplying liquid containing a sedimentary component to the liquid ejection apparatus 11. The liquid container 20 is provided with a bag 60 and an adapter 61. The bag 60 is flexible. The shape of the bag 60 may be a pillow type or a gusset type. The bag 60 of this embodiment is a pillow type bag formed by overlapping two rectangular films and joining the peripheral edges of the films to each other. The films that constitute the bag 60 are formed of a material that is flexible and has gas barrier properties. Examples of the material of the films include polyethylene terephthalate (PET), nylon, polyethylene, and the like. In addition, the films may be formed using a layered structure in which a plurality of films made of such materials are layered. In such a layered structure, for example, a configuration may be adopted in which the outer layer is made of PET or nylon that has excellent impact resistance, and the inner layer is made of polyethylene that has excellent ink resistance. Furthermore, a film including a layer acquired by vapor depositing aluminum or the like may be one constituent member of the layered structure.

A liquid storage portion 60*c* that contains liquid is provided in the bag 60. The liquid storage portion 60*c* contains ink, as the liquid, in which pigment as a sedimentary component is dispersed in a solvent. The bag 60 has one edge portion 60*a* and another edge portion 60*b* that opposes the one edge portion 60*a*. The adapter 61 is attached to the one edge portion 60*a* of the bag 60. The adapter 61 is provided with a liquid outlet portion 52 for leading out liquid in the liquid storage portion 60*c* to the liquid ejection apparatus 11. The liquid outlet portion 52 can also be referred to as a "supply port".

FIG. 4 shows three directions orthogonal to each other, namely, a D direction, a T direction, and a W direction. In this embodiment, the D direction is a direction that lies along a Y direction shown in FIG. 1, and in which the bag 60 extends. In the following description, in the D direction, a direction from the liquid outlet portion 52 toward the other edge portion 60*b* side of the bag 60 is assumed to be a +D direction, and the opposite direction to the +D direction is assumed to be a −D direction. Also, a direction in which the dimension of the outer shape of the liquid container 20 is smallest is assumed to be the T direction. A direction orthogonal to the D direction and the T direction is assumed to be the W direction. In this embodiment, the T direction is a direction along a Z direction, and a +T direction corresponds to a −Z direction. Also, the W direction is a direction along an X direction, and a +W direction corresponds to a +X direction.

When the edge of the mount body 50 that is positioned at the head when the mount body 50 is mounted to the mount portion 14 (see FIG. 2) is assumed to be a leading edge, and the edge on the opposite side to the leading edge is assumed to be a base edge, a connection structure 51 is provided in the leading edge portion. A first connection structure 51F and a second connection structure 51S are provided respectively on the two sides of the connection structure 51 sandwiching the liquid outlet portion 52 in the width direction.

The first connection structure 51F is provided with a connection terminal 53 arranged at a position vertically higher than the liquid outlet portion 52. For example, the connection terminal 53 is provided on the surface of a circuit substrate, and this circuit substrate includes a storage unit that stores various types of information regarding the liquid container 20 (for example, the type of the liquid container 20, the amount of liquid contained, and the like).

The connection terminal 53 is preferably arranged to be directed obliquely upward in a recessed portion 53*a* provided in an aspect of being open upward and in the mounting direction. In addition, guiding recessions 53*g* extending in the mounting direction are preferably arranged in the width direction on the two sides of the connection terminal 53.

The second connection structure 51S is preferably provided with an identification portion 54 for preventing erroneous insertion that is arranged higher than the liquid outlet portion 52 vertically. The identification portion 54 has recessions and projections that are shaped so as to fit the blocks 44 (see FIG. 3) of a corresponding connection mechanism 29.

The connection structure 51 is provided with a pair of positioning holes 55 and 56, biasing-receiving portions 57 that receive a biasing force of the biasing portion 47*c* (see FIG. 3), and an insertion portion 58 extending below the liquid outlet portion 52. The positioning holes 55 and 56 are aligned in the width direction so as to be respectively included in the first connection structure 51F and the second connection structure 51S, and to sandwich the liquid outlet portion 52. It is preferable that the first positioning hole 55 included in the first connection structure 51F is a circular hole while the second positioning hole 56 included in the second connection structure 51S is an elongated hole having a substantially elliptic shape longer in the width direction.

FIG. 5 is a perspective view of the liquid container 20 and the container 13 that constitute the mount body 50. A notch 65*a* that is engaged with the insertion portion 58 provided in the adapter 61 of the liquid container 20 is formed at the leading edge of the container 13. Furthermore, a first hole 55*a* and a second hole 56*a* are formed on the two sides in the width direction of the notch 65*a*, and a first hole 55*b* and a second hole 56*b* are formed at the leading edge of the adapter 61. When the liquid container 20 is placed on the container 13, the first holes 55*a* and 55*b* are aligned in the depth direction, and the second holes 56*a* and 56*b* are aligned in the depth direction, such that the first holes 55*a* and 55*b* constitute the first positioning hole 55, and the second holes 56*a* and 56*b* constitute the second positioning hole 56.

The adapter 61 is provided with a handle portion 62. The handle portion 62 is constituted by a member different from the adapter 61, and can move relative to the adapter 61. Specifically, the handle portion 62 can move by rotating centered on a rotation shaft 63 provided on the adapter 61. The rotation shaft 63 is formed so as to be open on two sides in the width direction, and a semi-cylindrical shaped portion of the rotation shaft 63 having a bottom protrudes from the upper face of the adapter 61.

The handle portion 62 has a grip portion 62*a* that is gripped by the user. The grip portion 62*a* is positioned on the bag 60 side distanced more from the adapter 61 in the depth direction than an axis portion 62*b* pivotally supported by the rotation shaft 63. The handle portion 62 can pivot between a first orientation where the grip portion 62*a* is positioned at the same height as or below the rotation shaft 63 and a second orientation where the grip portion 62*a* is positioned at a higher position than the rotation shaft 63.

An engagement-receiving portion 65 with which the adapter 61 of the liquid container 20 can be engaged is provided at the leading edge portion of the container 13. The adapter 61 includes the connection terminal 53, the recessed portion 53*a*, the guiding recession 53*g*, the identification portion 54, the first hole 55*b*, and the second hole 56*b*. The engagement-receiving portion 65 of the container 13 includes the biasing-receiving portion 57, the first hole 55*a*, and the second hole 56*a*. The adapter 61 is positioned at the leading edge portion of the container 13 when engaged with the engagement-receiving portion 65.

The container 13 is provided with a bottom plate 67 that constitutes the bottom face, side plates 68 standing vertically upward from the two ends in the width direction of the bottom plate 67, and a front plate 69 standing vertically upward from the base edge of the bottom plate 67, and a leading plate 70 standing vertically upward from the leading edge of the bottom plate 67.

In the container 13, the bottom plate 67, the side plates 68, the front plate 69, and the leading plate 70 constitute a main body portion that forms the storage space in which the liquid container 20 is stored. The container 13 has an opening 13*a* for inserting/removing the liquid container 20 into/from the storage space. In this embodiment, the opening 13*a* of the container 13 is open in a direction (the vertically upward direction) other than a direction in which the container 13 advances when mounted to the mount portion 14 (the mounting direction).

The adapter 61 of the liquid container 20 is provided with a plurality of (in this embodiment, two) guide portions 72 formed in the shape of a substantially circular hole to pass through the adapter 61 in the guiding direction. In this embodiment, two guide portions 72 are formed so as to be aligned in the width direction.

In addition, the engagement-receiving portion 65 of the container 13 is provided with a plurality of (in this embodiment, two) substantially columnar-shaped guiding portions 73 protruding from the bottom plate 67 in the guiding direction. In this embodiment, two guiding portions 73 are formed so as to be aligned in the width direction. Note that the guiding direction is a direction that intersects (is preferably orthogonal to) the bottom plate 67 or the opening 13*a*, and lies along the side plates 68.

The guiding portions 73 provided in the container 13 guide the guide portions 72 provided in the adapter 61 in the guiding direction. In other words, the guide portions 72 provided in the adapter 61 are guided in the guiding direction by the guiding portions 73 provided in the container 13.

In this embodiment, the guiding portions 73 have a protruding semi-cylindrical shape, and the side faces of the guiding portions 73 that lie along the guiding direction consist of a flat restriction portion 73*a* positioned on the leading edge side and a curved face portion 73*b* on the base edge side relative to the restriction portion 73*a*.

The guide portions 72 are formed into a shape including a restriction portion 72*a* and a curved face portion 72*b* so as to extend along the shape of the guiding portions 73. The restriction portions 72*a* and 73*a* restrict escape and rotation of the liquid container 20 placed on the container 13.

Furthermore, for example, a dome shaped protrusion 75 in which at least the corner in the guiding direction is chamfered is formed on the leading edge face of the adapter 61. In addition, an engagement hole 76 that is engaged with the protrusion 75 is formed in the leading plate 70 of the container 13. With such a configuration, when the liquid container 20 is placed on the container 13, sense or tactile feeling (click) indicating that engagement between the container 13 and the liquid container 20 is complete can be felt by the user. The protrusion 75 and the engagement hole 76 of this embodiment are formed so as to be aligned as a pair on each of the two sides in the width direction, sandwiching the liquid outlet portion 52 of the adapter 61 and the notch 65*a* of the container 13.

Here, connection between the connection structure 51 of the mount body 50 and the connection mechanism 29 will be described with reference to FIGS. 3 and 4. When the mount body 50 is inserted into the storage space, and the leading edge approaches the connection mechanism 29, first, the leading ends of the positioning protrusions 45 and 46, which has the longer protrusion length of the two in the removal direction, engage with the positioning holes 55 and 56 of the mount body 50 in an aspect of being inserted into the positioning holes 55 and 56, and restrict movement of the mount body 50 in the width direction. The second positioning hole 56 is an elliptic-shaped elongated hole extending in the width direction, and thus the positioning protrusion 45 that is inserted into the circular first positioning hole 55 serves as a reference for positioning.

When the mount body 50 advances even farther after the positioning protrusions 45 and 46 engage with the positioning holes 55 and 56, the biasing-receiving portion 57 comes into contact with the pressing portion 47*b*, and receives a biasing force of the biasing portion 47*c*, and the liquid outlet portion 52 of the liquid container 20 is connected to the ink introduction needle 32. The positioning protrusions 45 and 46 preferably position the mount body 50 before the ink introduction needle 32 is connected to the liquid outlet portion 52 in this manner.

If the mount body 50 is inserted at an appropriate position, the identification portion 54 is appropriately fitted with the blocks 44 of the connection mechanism 29. On the other hand, if an attempt is made to mount the mount body 50 at an inappropriate position, the identification portion 54 does not fit to the blocks 44, and thus the mount body 50 cannot advance any farther, thereby preventing erroneous insertion.

In addition, when the mount body 50 advances in the mounting direction, the terminal portion 40 enters the recessed portion 53*a* of the mount body 50, and the position of the terminal portion 40 is adjusted by the guiding recession 53*g* being guided by the guiding projections 40*a*, such that the terminal portion 40 comes into contact with the connection terminal 53. Thus, the connection terminal 53 is electrically connected to the terminal portion 40, and information is exchanged between the circuit substrate and the control apparatus 42. In this manner, the first positioning hole 55 that serves as a reference for positioning is preferably arranged in the first connection structure 51F including the connection terminal 53 out of the first connection structure 51F and the second connection structure 51S.

When the liquid outlet portion 52 of the liquid container 20 is connected to the ink introduction needle 32 in a state where liquid can be supplied to the ink introduction needle 32, and the connection terminal 53 comes into contact with and is electrically connected to the terminal portion 40, connection of the connection structure 51 to the connection mechanism 29 is complete.

Figure 6:
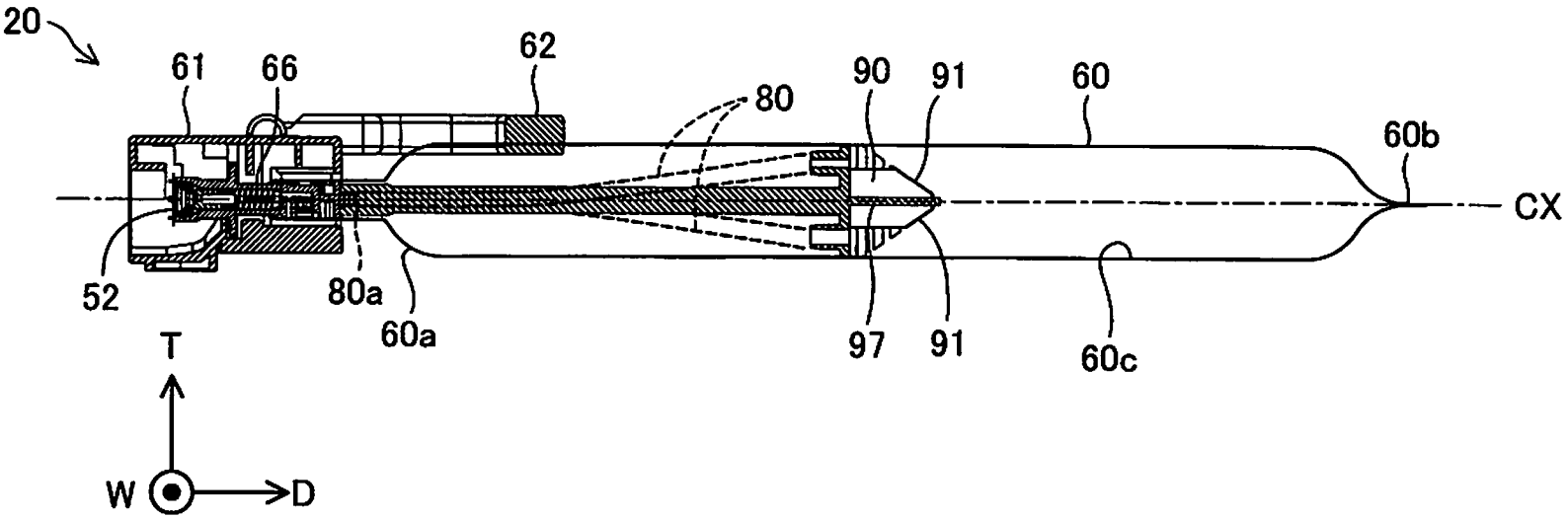
FIG. 6 is a VI-VI cross-sectional view of the liquid container in FIG. 5.

FIG. 6 is a VI-VI cross-sectional view of the liquid container 20 in FIG. 5. FIG. 6 shows a central axis CX of the liquid outlet portion 52 having a cylindrical shape. In the adapter 61, the liquid container 20 has a liquid outlet member 66 provided integrally with the liquid outlet portion 52. The liquid outlet member 66 is attached to the one edge portion 60*a* of the bag 60. The liquid container 20 is provided with a liquid outlet tube 80 and a spacer member 90, in the liquid storage portion 60*c* provided in the bag 60. The liquid outlet tube 80 is a flexible tube made of an elastomer, for example. The liquid outlet tube 80 has a base end portion 80*a* connected to the liquid outlet member 66, in the liquid storage portion 60*c*. The liquid outlet tube 80 extends from the liquid outlet member 66 toward the other edge portion 60*b* side in the liquid storage portion 60*c*. A channel that allows the liquid outlet tube 80 and the liquid outlet portion 52 to communicate with each other is formed inside of the liquid outlet member 66. The liquid outlet member 66 fixes the liquid outlet portion 52, the bag 60, the liquid outlet tube 80, and the spacer member 90 to the adapter 61.

The spacer member 90 is a structure for defining a region having a certain capacity in the bag 60. The spacer member 90 is made of a synthetic resin such as polyethylene or polypropylene. The spacer member 90 has a portion positioned on the +D direction side relative to the liquid outlet tube 80. In addition, the spacer member 90 is provided at a position intersecting the TD plane that includes the central axis CX of the liquid outlet portion 52. The TD plane refers to a plane including the T direction and the D direction. The spacer member 90 has, on the +D direction side, a face 91 inclined such that the dimension in the T direction of the spacer member 90 increases from the +D direction side toward the −D direction side. Hereinafter, the face 91 is referred to as an "inclined face 91". In this embodiment, the spacer member 90 has inclined faces 91 respectively on the +T direction side and the −T direction side relative to the central axis CX. Therefore, the spacer member 90 has a shape pointed toward the +D direction side, when viewed from the W direction. Note that in this embodiment, a "face" includes not only a face constituted only by a flat face, but also a face on which a groove, a recessed portion or the like is formed, a face on which a protrusion or a projection is formed, and a virtual face surrounded by a frame. In other words, as long as the face can be grasped as being a "face" overall, a certain region occupied by the face may include recessions, projections, and a through hole.

In an orientation in which the liquid container 20 is mounted in the liquid ejection apparatus 11, at least one of the lowermost portion and the uppermost portion of the spacer member 90 come into contact with the internal face of the bag 60. In this embodiment, as shown in FIG. 6, both the lowermost portion and the uppermost portion of the spacer member 90 are in contact with the internal face of the bag 60. Hereinafter, the orientation in which the liquid container 20 is mounted in the liquid ejection apparatus 11 is referred to as "a mounted orientation". In this embodiment, in the mounted orientation, the center between the heights of the lowermost portion and the uppermost portion of the spacer member 90 is the same as the height of the central axis CX of the liquid outlet portion 52.

Figure 7:
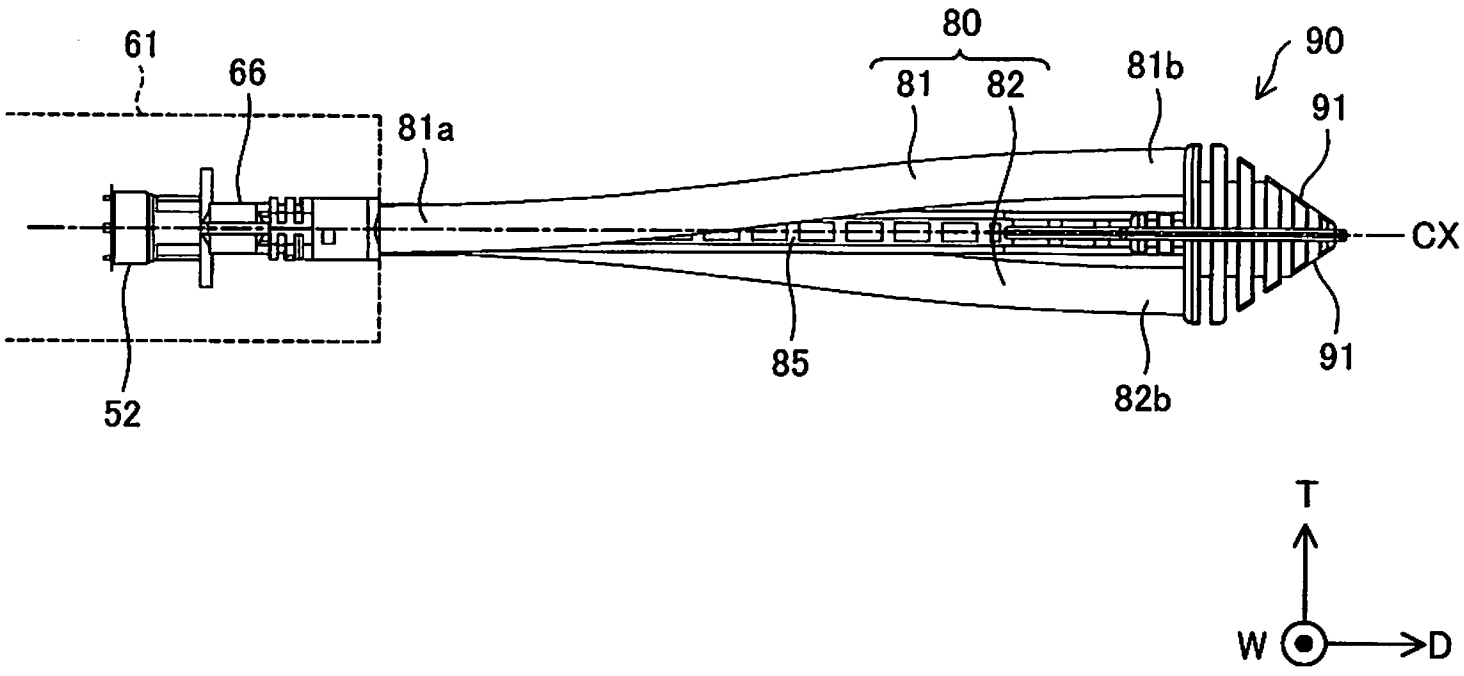
FIG. 7 is a side view of a spacer member and a liquid outlet tube.
Figure 8:
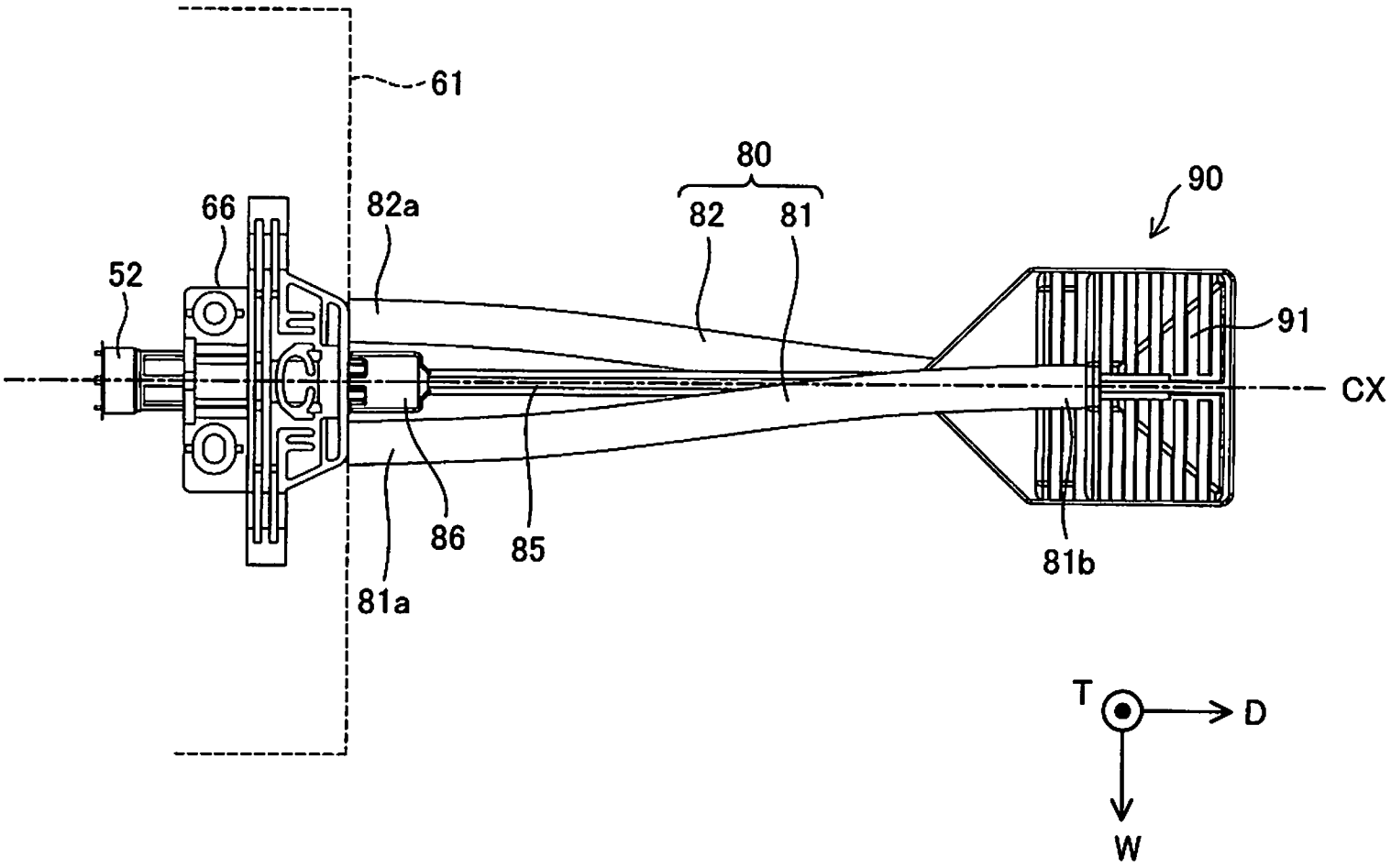
FIG. 8 is a plan view of the spacer member and the liquid outlet tube.

FIG. 7 is a side view of the spacer member 90 and the liquid outlet tube 80. FIG. 8 is a plan view of the spacer member 90 and the liquid outlet tube 80. The liquid outlet tube 80 is configured to extend in the horizontal direction from the liquid outlet portion 52 in the liquid storage portion 60*c* (FIG. 6) in the mounted orientation. In addition, in this embodiment, the spacer member 90 is fixed to the liquid outlet member 66 by a bar-like coupling member 85. In this embodiment, the coupling member 85 is connected integrally with the spacer member 90. An engaging portion 86 that is engaged with and fixed to a claw portion 59 (FIG. 18) provided in the face on the +D direction side of the liquid outlet member 66 is provided at the end portion on the −D direction side of the coupling member 85. Note that in another embodiment, the spacer member 90 does not need to be fixed to the liquid outlet member 66. For example, a structure may be adopted in which the spacer member 90 is fixed to the internal face of the bag 60.

In this embodiment, the liquid container 20 has a first channel portion 81 and a second channel portion 82 as the liquid outlet tube 80. In other words, the liquid container 20 has two liquid outlet tubes 80. In this embodiment, the first channel portion 81 and the second channel portion 82 have the same length. The first channel portion 81 has a first base end portion 81*a* that is connected to the liquid outlet member 66 and a first leading end portion 81*b* for introducing the liquid in the liquid storage portion 60*c* into the first channel portion 81. The second channel portion 82 has a second base end portion 82*a* that is connected to the liquid outlet member 66 and a second leading end portion 82*b* for introducing liquid in the liquid storage portion 60*c* into the second channel portion 82. Moreover, as shown in FIG. 7, in the mounted orientation, the first leading end portion 81*b* is positioned above the second leading end portion 82*b*. As shown in FIG. 8, the above-described engaging portion 86 is arranged so as to be sandwiched by the first base end portion 81*a* of the first channel portion 81 and the second base end portion 82*a* of the second channel portion 82 in the horizontal direction. Note that in another embodiment, the liquid container 20 may be provided with three or more liquid outlet tubes 80.

As shown in FIGS. 7 and 8, in this embodiment, in the mounted orientation, the first base end portion 81*a* of the first channel portion 81 and the second base end portion 82*a* of the second channel portion 82 are aligned in the horizontal direction, and the first leading end portion 81*b* of the first channel portion 81 and the second leading end portion 82*b* of the second channel portion 82 are aligned in the vertical direction. Therefore, liquid suctioned from the first channel portion 81 and liquid suctioned from the second channel portion 82 are converted from a state of flowing side by side in the vertical direction into a state of flowing side by side in the horizontal direction, are then mixed in the liquid outlet member 66, and are lead out from the liquid outlet portion 52 to the liquid ejection apparatus 11. Note that in another embodiment, it is possible to adopt a mode in which the first base end portion 81*a* and the second base end portion 82*a* are aligned in the vertical direction, and the first leading end portion 81*b* and the second leading end portion 82*b* are aligned in the horizontal direction, a mode in which the first base end portion 81*a* and the second base end portion 82*a* are aligned in the vertical direction, and the first leading end portion 81*b* and the second leading end portion 82*b* are also aligned in the vertical direction, and a mode in which the first base end portion 81*a* and the second base end portion 82*a* are aligned in the horizontal direction, and the first leading end portion 81*b* and the second leading end portion 82*b* are also aligned in the horizontal direction.

Figure 9:
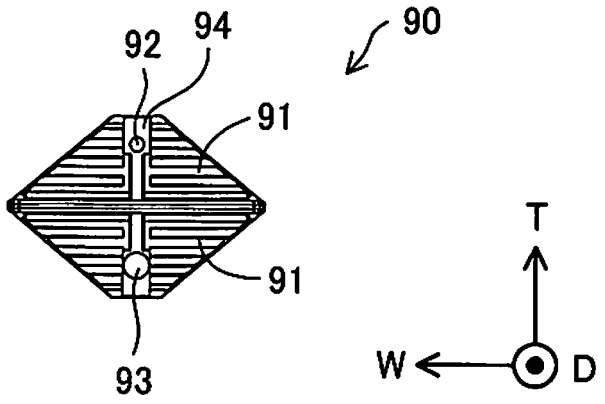
FIG. 9 is a front view of the spacer member.
Figure 10:
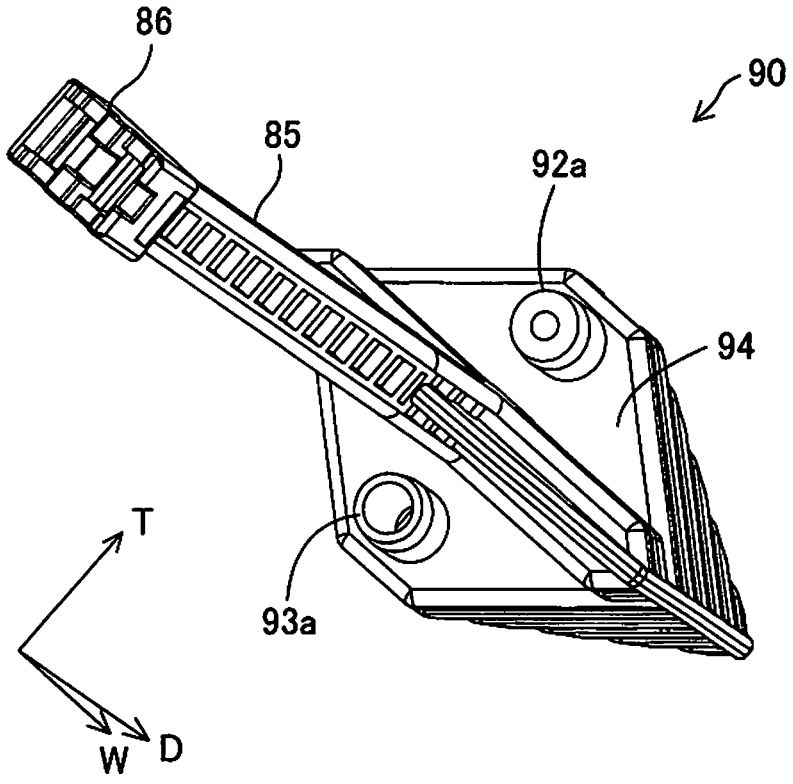
FIG. 10 is a perspective view of a rear side of the spacer member.

FIG. 9 is a front view of the spacer member 90. FIG. 10 is a perspective view of the rear side of the spacer member 90. The spacer member 90 has a first introduction port 92 and a second introduction port 93. The first introduction port 92 is an opening for introducing liquid relatively on the upper side in the liquid storage portion 60*c* into the first channel portion 81. The second introduction port 93 is an opening for introducing liquid relatively on the lower side in the liquid storage portion 60*c* into the second channel portion 82. The spacer member 90 has, at a section at which the dimension in the T direction of the spacer member 90 is the largest, a rear face member 94 parallel to and along the TW plane. The rear face member 94 has a substantially hexagonal shape whose upper side and lower side are horizontal. The first introduction port 92 and the second introduction port 93 are provided in this rear face member 94. In this embodiment, the internal diameter of the first introduction port 92 is smaller than the internal diameter of the second introduction port 93. In other words, the internal diameter of the second introduction port 93 is larger than the internal diameter of the first introduction port 92. Therefore, the second introduction port 93 positioned below the first introduction port 92 suctions liquid in the liquid storage portion 60*c* more easily. Note that as shown in FIG. 9, in this embodiment, the spacer member 90 has an inclined face not only on the +D direction side but also on the +W direction side and a −W direction side.

The first introduction port 92 and the second introduction port 93 face in the +D direction. In addition, the first introduction port 92 and the second introduction port 93 are provided at positions symmetrical in the T direction relative to the central axis CX of the liquid outlet portion 52 shown in FIG. 6. The first introduction port 92 is provided above the central axis CX, and the second introduction port 93 is provided below the central axis CX.

Figure 11:
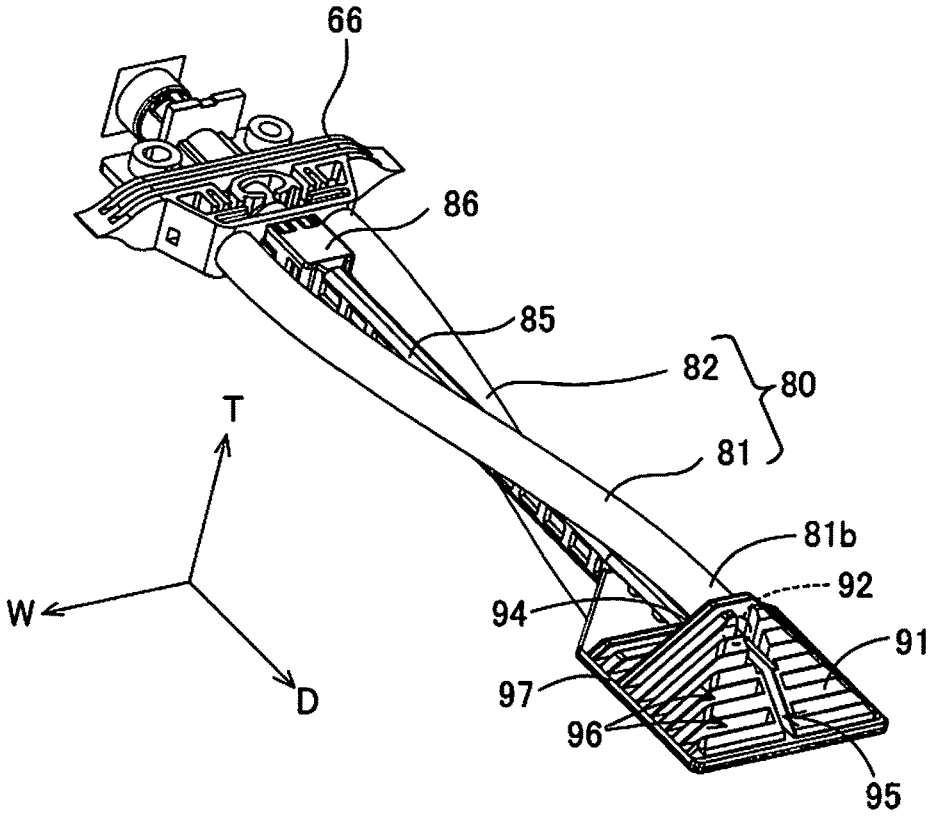
FIG. 11 is a first perspective view of the spacer member and the liquid outlet tube.

FIG. 11 is a first perspective view of the spacer member 90 and the liquid outlet tube 80. The first leading end portion 81*b* of the first channel portion 81 of the liquid outlet tube 80 is connected to the first introduction port 92. More specifically, a cylindrical first connection tube 92*a* that is in communication with the first introduction port 92 is provided on the face on the −D direction side of the rear face member 94 (FIG. 10), and this first connection tube 92*a* is inserted into the first leading end portion 81*b* of the first channel portion 81, and thereby the first leading end portion 81*b* of the first channel portion 81 is connected to the first introduction port 92.

Figure 12:
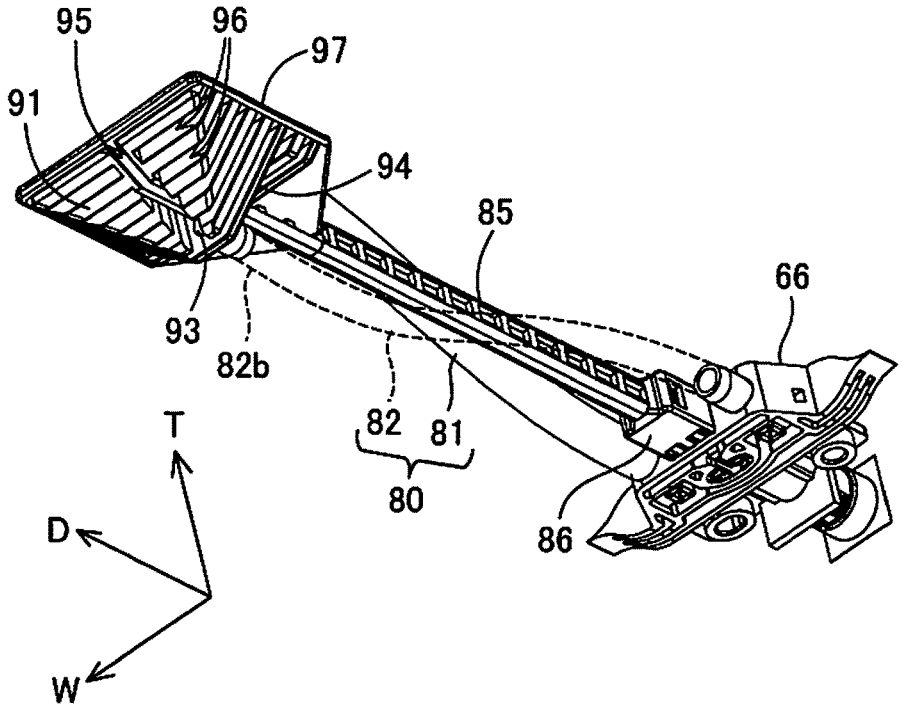
FIG. 12 is a second perspective view of the spacer member and the liquid outlet tube.

FIG. 12 is a second perspective view of the spacer member 90 and the liquid outlet tube 80. The second leading end portion 82*b* of the second channel portion 82 of the liquid outlet tube 80 is connected to the second introduction port 93. More specifically, a cylindrical second connection tube 93*a* that is in communication with the second introduction port 93 is provided on the face on the −D direction side of the rear face member 94 (FIG. 10), and this second connection tube 93*a* is inserted into the second leading end portion 82*b* of the second channel portion 82, and thereby the second leading end portion 82*b* of the second channel portion 82 is connected to the second introduction port 93. In this embodiment, the lengths in the D direction of the second connection tube 93*a* and the first connection tube 92*a* are the same.

As shown in FIGS. 11 and 12, in this embodiment, the first leading end portion 81*b* of the first channel portion 81 and the second leading end portion 82*b* of the first channel portion 81 are fixed to the spacer member 90. On the other hand, in another embodiment, at least one of the first leading end portion 81*b* of the first channel portion 81 and the second leading end portion 82*b* of the second channel portion 82 may be separated from the spacer member 90. In this case, the first leading end portion 81*b* or the second leading end portion 82*b* separated from the spacer member 90 may introduce liquid directly, without the spacer member 90 being interposed therebetween.

As shown in FIGS. 11 and 12, the spacer member 90 is provided with a groove-shaped first channel 95 and second channels 96. The first channel 95 is a channel for flowing liquid from the +D direction to the first introduction port 92 and the second introduction port 93 positioned in the −D direction. The second channels 96 are channels for circulating liquid in a direction intersecting the D direction. In this embodiment, a plurality of second channels 96 are formed. The second channels 96 are constituted by forming grooves extending vertically along the W direction from the inclined face 91 of the spacer member 90. Note that the second channels 96 may be formed so as to circulate liquid in a direction intersecting both the W direction and the D direction. In addition, in another embodiment, at least one of the first channel 95 and the second channel 96 can be omitted.

In this embodiment, the spacer member 90 is provided with a plate-like partition portion 97 that lies along the horizontal plane (the DW plane). The partition portion 97 is provided at a position between the first leading end portion 81*b* and the second leading end portion 82*b*, namely, a position between the first introduction port 92 and the second introduction port 93, in the T direction. In this embodiment, the central axis CX of the liquid outlet portion 52 is included in the partition portion 97 (FIG. 6). In other words, in this embodiment, the partition portion 97 is provided horizontally at the center of the liquid storage portion 60*c*. It can also be said that a plurality of channels 96 are formed on the partition portion 97 by a plurality of ribs being provided. Note that in another embodiment, the partition portion 97 may be omitted.

Figure 13:
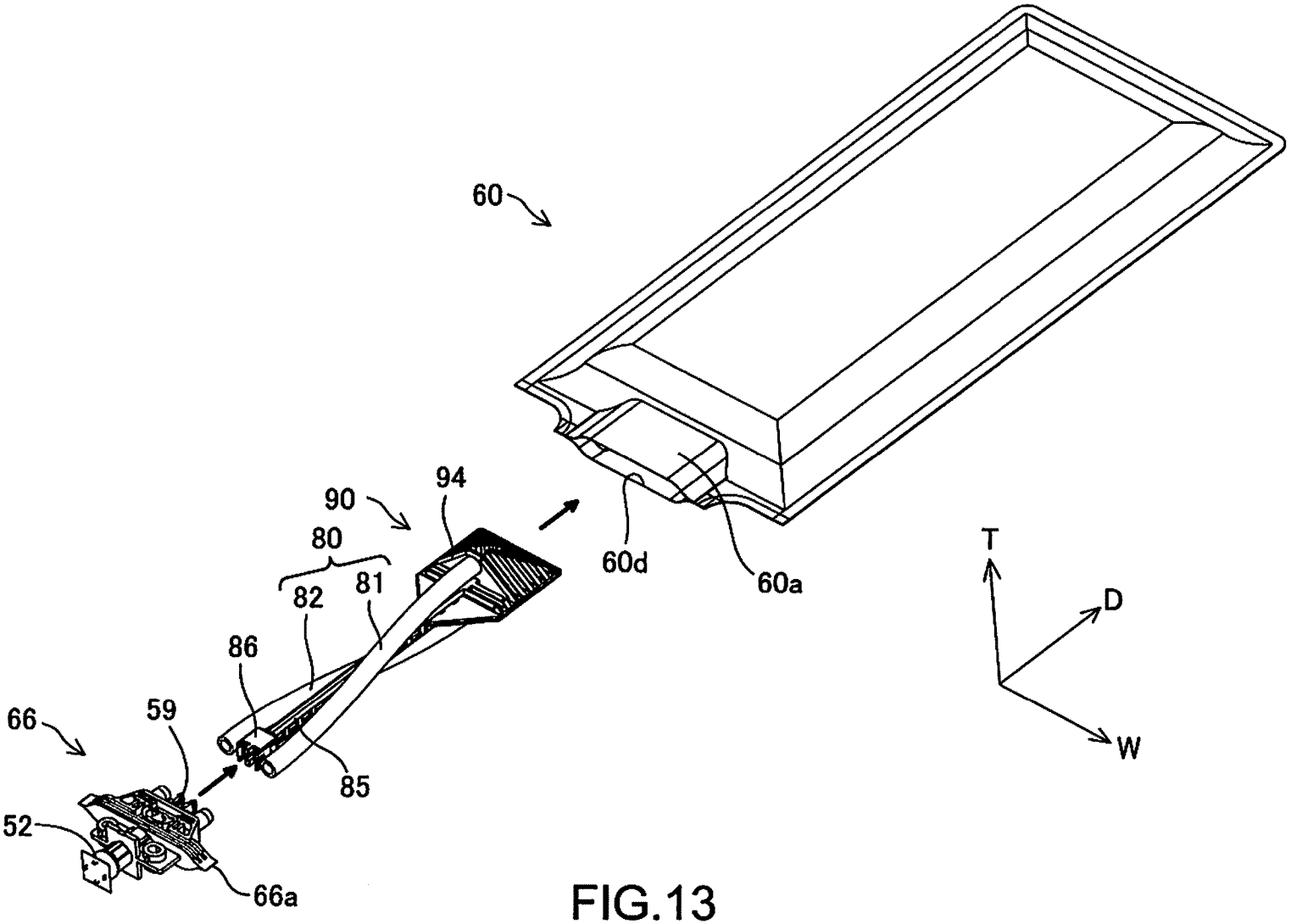
FIG. 13 is a first exploded perspective view of a portion of the liquid container.
Figure 14:
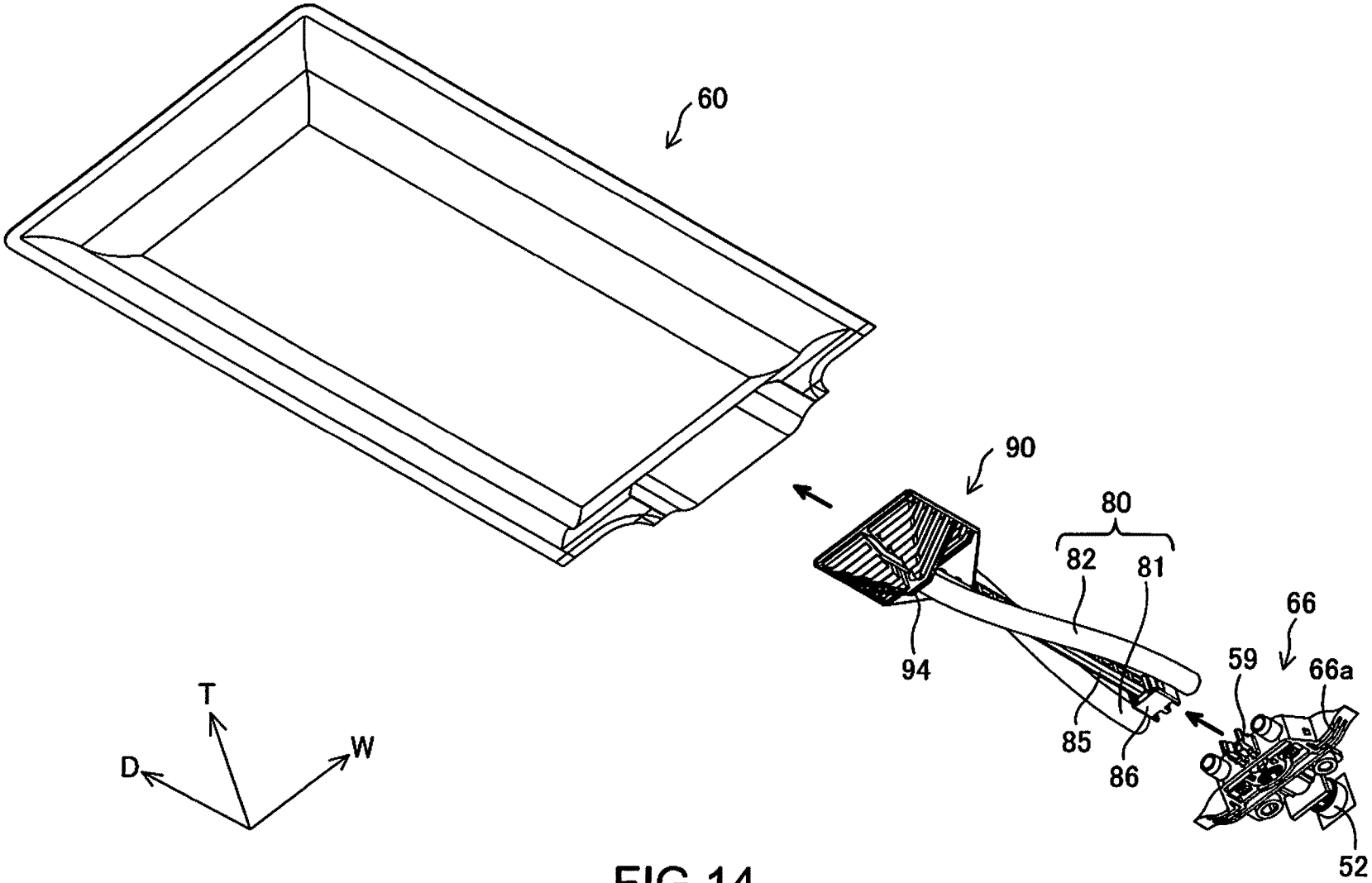
FIG. 14 is a second exploded perspective view of a portion of the liquid container.

FIG. 13 is a first exploded perspective view of a portion of the liquid container 20. FIG. 14 is a second exploded perspective view of a portion of the liquid container 20. When manufacturing the liquid container 20, first, the spacer member 90 is fixed to the liquid outlet member 66 by connecting the engaging portion 86 provided on the coupling member 85 to the claw portion 59 provided in the liquid outlet member 66. The liquid outlet tube 80 (the first channel portion 81 and the second channel portion 82) is connected to the spacer member 90 and the liquid outlet member 66. The liquid outlet member 66 to which the spacer member 90 and the liquid outlet tube 80 are connected is inserted from the spacer member 90 side into the bag 60 in which an opening portion 60*d* is provided in advance on the one edge portion 60*a* side, through the opening portion 60*d*. When the spacer member 90 and the liquid outlet tube 80 are inserted into the bag 60, the opening portion 60*d* of the bag 60 is welded and joined to a welded portion 66*a* provided in the outer periphery of the liquid outlet member 66. The welded portion 66*a* is a section in which the outer periphery of the liquid outlet member 66 is the largest. The size of the inner periphery of the opening portion 60*d* is larger than or equal to the size of the outer periphery of the welded portion 66*a* of the liquid outlet member 66. In addition, the size of the outer periphery of the welded portion 66*a* of the liquid outlet member 66 is larger than the size of the outer periphery of the rear face member 94 that has the largest outer periphery in the spacer member 90. Accordingly, in this embodiment, the spacer member 90 that is inserted into the bag 60 before the liquid outlet member 66 has a smaller outer periphery than the liquid outlet member 66, and thus the spacer member 90 can be easily inserted into the bag 60 during the manufacture of the liquid container 20. Therefore, it is possible to suppress damage due to the bag 60 excessively coming into contact with the spacer member 90 during manufacturing. Hereinafter, the bag 60 into which the spacer member 90 and the liquid outlet tube 80 are inserted, and whose opening portion 60*d* is welded to the welded portion 66*a* of the liquid outlet member 66 is referred to as a "bag unit 60*u*".

Figure 15:
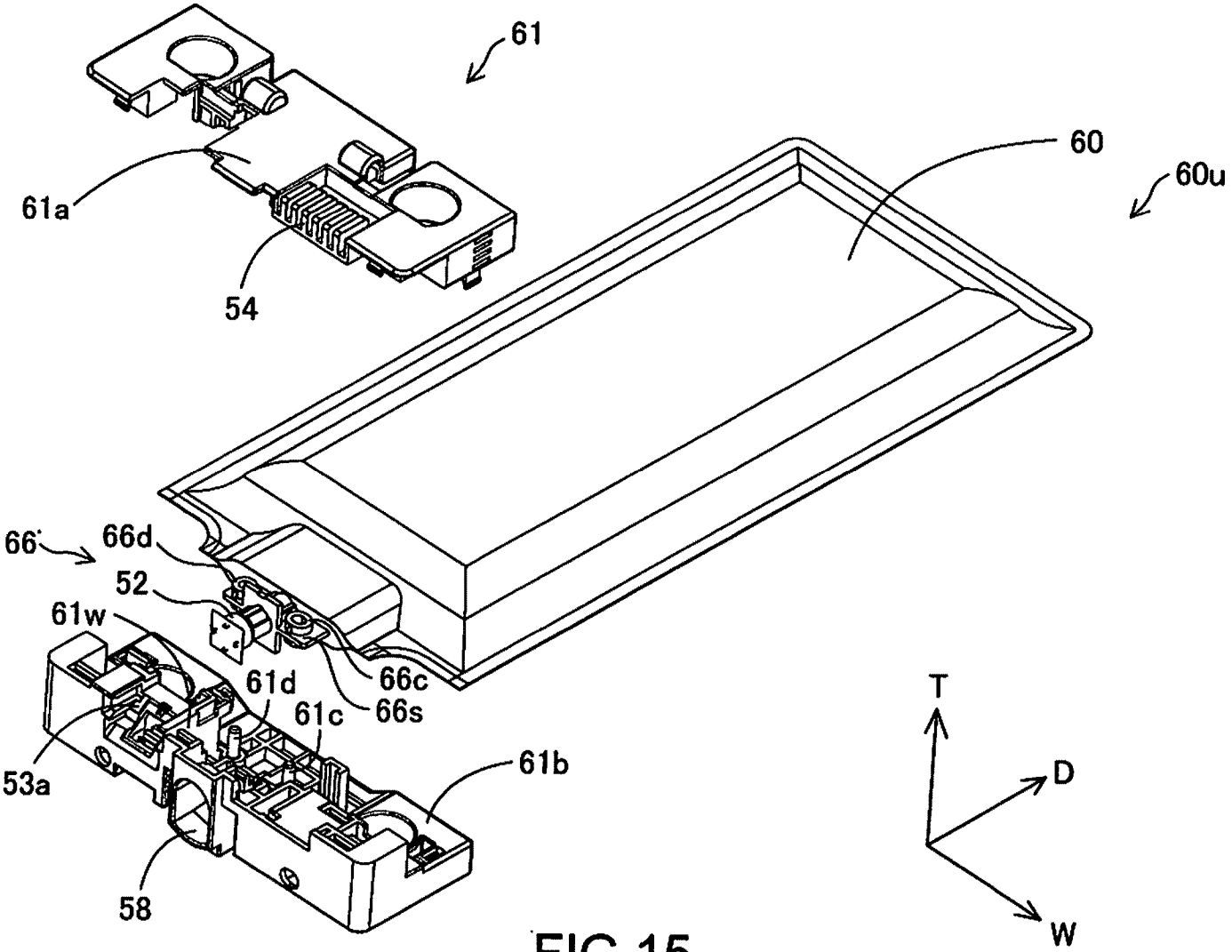
FIG. 15 is an exploded perspective view of an adapter.

FIG. 15 is an exploded perspective view of the adapter 61. The adapter 61 can be separated in the T direction, and is provided with a lid member 61*a* and a bottom member 61*b*. The bag unit 60*u* is fixed to the adapter 61 due to the lid member 61*a* and the bottom member 61*b* sandwiching the edge portion on the −D direction side of the bag unit 60*u* from the +T direction side and the T direction side.

The identification portion 54 is mainly formed in the lid member 61*a*. The insertion portion 58 and the recessed portion 53*a* are mainly formed in the bottom member 61*b*. In this embodiment, a first protrusion 61*c* and a second protrusion 61*d* are provided on the bottom member 61*b* so as to be directed in the +T direction. The first protrusion 61*c* and the second protrusion 61*d* are provided at positions sandwiching the insertion portion 58 in the W direction. A fixing portion 66*s* provided at a portion of the liquid outlet member 66 that is exposed from the bag 60 in the −D direction is provided with a first through hole 66*c* and a second through hole 66*d* at positions sandwiching the liquid outlet portion 52. The first protrusion 61*c* is inserted into the first through hole 66*c*, and the second protrusion 61*d* is inserted into the second through hole 66*d*. A portion of the edge portion on the −D direction side of the bag 60 along with the fixing portion 66*s* of the liquid outlet member 66 is sandwiched between the lid member 61*a* and the bottom member 61*b*.

Figure 16:
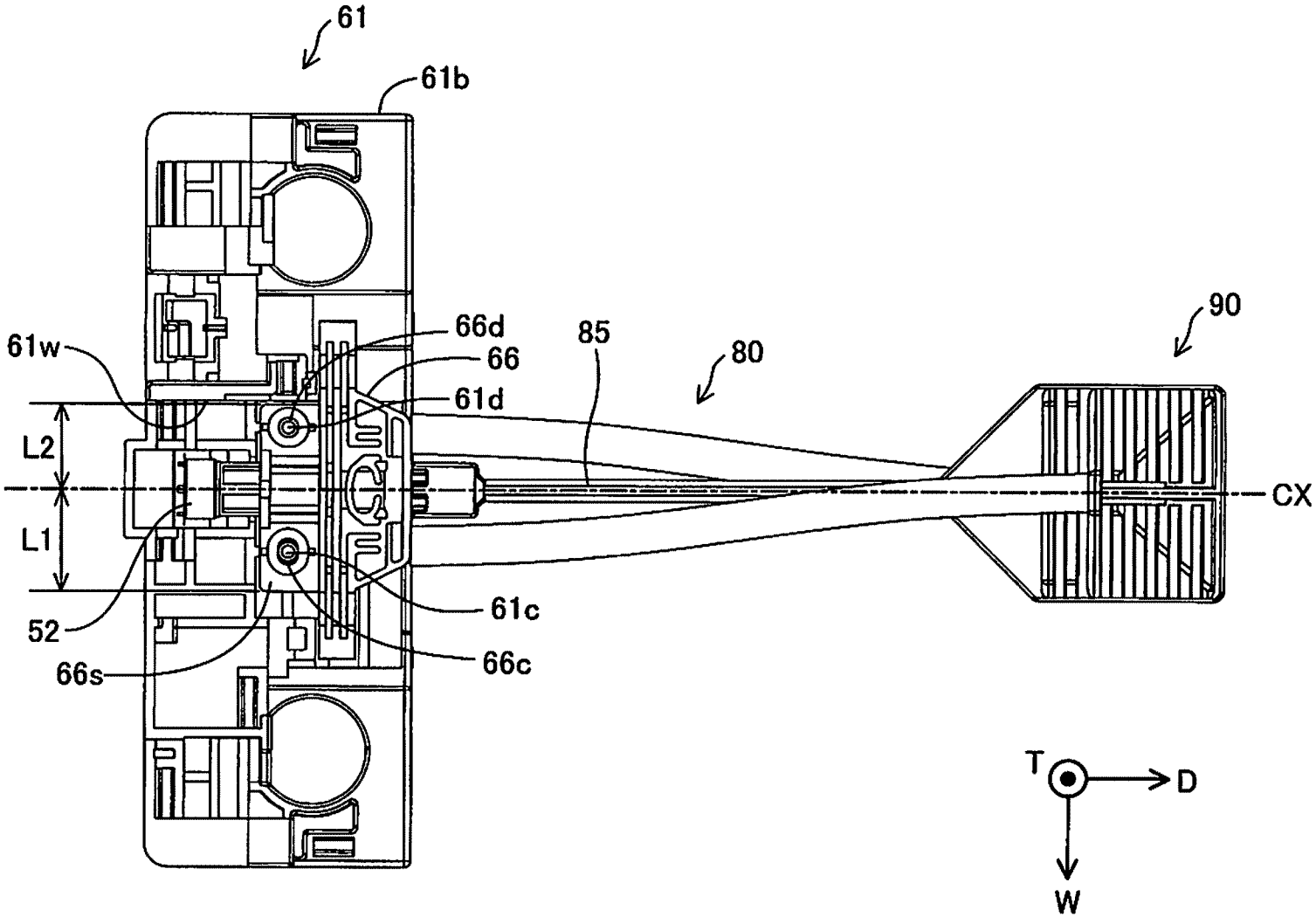
FIG. 16 is a plan view showing a state where a liquid outlet member is fixed to a bottom member.
Figure 17:
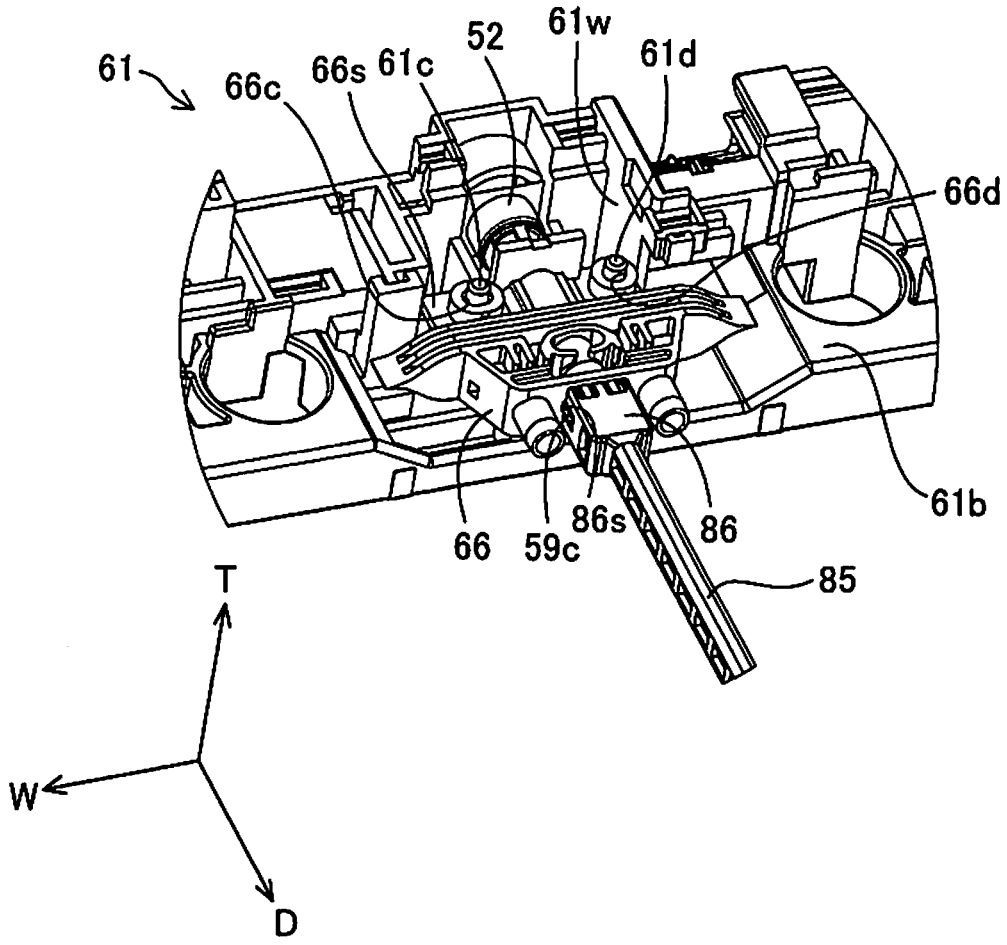
FIG. 17 is a perspective view of the liquid outlet member portion in FIG. 16.

FIG. 16 is a plan view showing a state where the liquid outlet member 66 is fixed to the bottom member 61*b*. FIG. 17 is a perspective view of the liquid outlet member 66 part in FIG. 16. In FIGS. 16 and 17, illustration of the bag 60 is omitted. As described above, the first through hole 66*c* into which the first protrusion 61*c* is inserted and the second through hole 66*d* into which the second protrusion 61*d* is inserted are provided at positions sandwiching the liquid outlet portion 52 in the fixing portion 66*s* of the liquid outlet member 66. The first through hole 66*c* and the second through hole 66*d* are provided at substantially the same distance in opposite directions from the central axis CX of the liquid outlet portion 52, and are aligned in the W direction. The length of the fixing portion 66*s* from the central axis CX in the +W direction and the length of the fixing portion 66*s* in the −W direction are different. Specifically, a length L2 of the fixing portion 66*s* from the central axis CX in the −W direction, which is on the second protrusion 61*d* side, is shorter than a length L1 of the fixing portion 66*s* in the +W direction, which is on the first protrusion 61*c* side (L2<L1). In other words, the liquid outlet member 66 is formed to be asymmetrical relative to the central axis CX between the −W direction and the +W direction. In addition, a contact wall 61*w* is provided on the bottom member 61*b*, and is directed in the +T direction so as to be in contact with the end portion on the −W direction side of the fixing portion 66*s* on which the length of the fixing portion 66*s* is shorter. In this embodiment, with such a structure, the liquid outlet member 66 is prevented from being mounted to the bottom member 61*b* in a vertically inversed manner. Note that the first through hole 66*c* provided in the fixing portion 66*s* is preferably a substantially elliptic shaped elongated hole longer in the W direction in order to prevent the liquid outlet member 66 from being disabled to be mounted to the bottom member 61*b* due to a manufacturing error.

Figure 18:
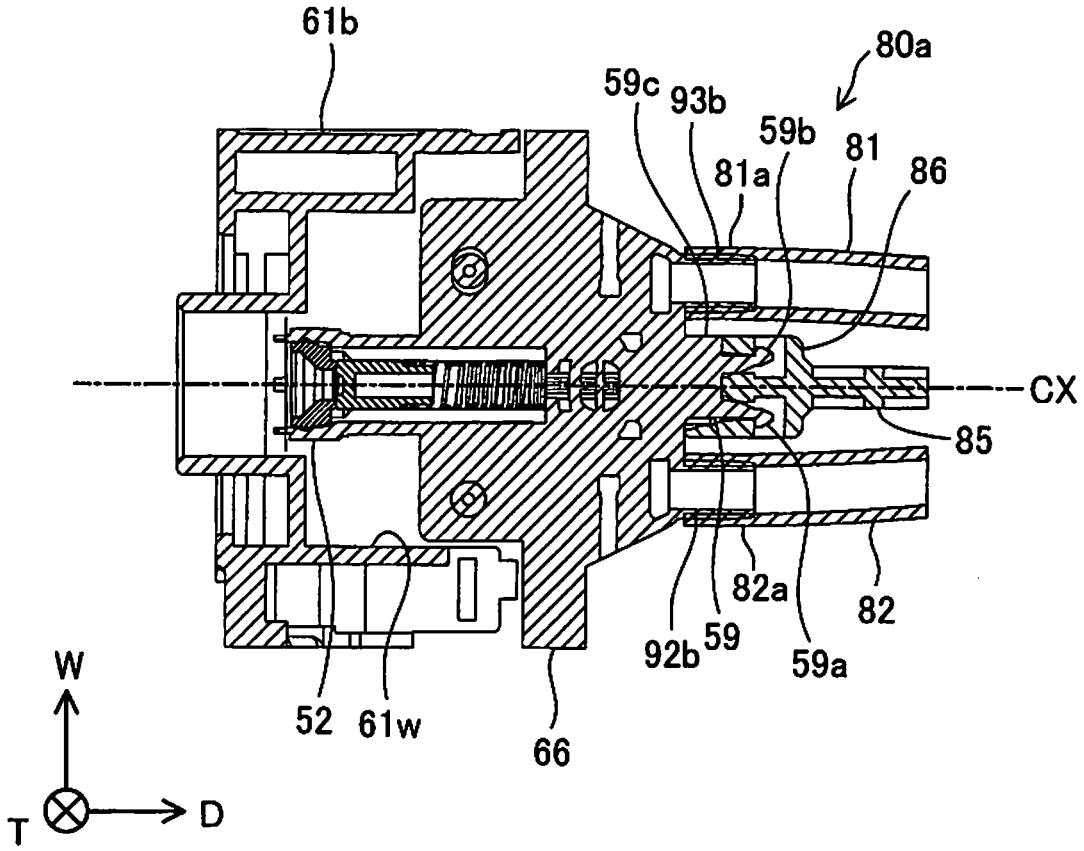
FIG. 18 is a cross-sectional view of an engaging portion and a claw portion provided in the liquid outlet member.

FIG. 18 is a cross-sectional view of the engaging portion 86 provided on the coupling member 85 and the claw portion 59 provided in the liquid outlet member 66. The claw portion 59 is provided with a first claw 59*a* and a second claw 59*b* that extend in the +D direction, and are aligned in the W direction. The first claw 59*a* is arranged on the −W direction side, and the second claw 59*b* is arranged on the +W direction side. The leading end portions in the +D direction of the first claw 59*a* and the second claw 59*b* are respectively provided with protrusions directed in the opposite directions, and are fitted in openings provided in side faces of the engaging portion 86. Also as shown in FIG. 17, at the base end portion on the +W direction side of the second claw 59*b*, a rib 59*c* is formed from the −D direction toward the +D direction. The engaging portion 86 is provided with a slit 86*s* at a position corresponding to this rib 59*c*. In this embodiment, with such a structure, the spacer member 90 leading to the engaging portion 86 is prevented from being connected to the liquid outlet member 66 in a vertically inverted manner.

As shown in FIG. 18, at the end portion in the +D direction side of the liquid outlet member 66, a third cylindrical connection tube 92*b* and a fourth cylindrical connection tube 93*b* are arranged so as to protrude in the +D direction, and are aligned in the W direction so as to sandwich the claw portion 59. In this embodiment, the distance from the central axis CX of the liquid outlet portion 52 to the third connection tube 92*b* and the distance from the central axis CX to the fourth connection tube 93*b* are equal. The third connection tube 92*b* and the fourth connection tube 93*b* communicate with the liquid outlet portion 52, in the liquid outlet member 66. The third connection tube 92*b* is inserted at the base end portion of the second channel portion 82, and the fourth connection tube 93*b* is inserted at the base end portion of the first channel portion 81, and thus the liquid outlet tube 80 (the first channel portion 81 and the second channel portion 82) is fixed to the liquid outlet member 66.

In this embodiment, the internal diameters of the first channel portion 81 and the second channel portion 82 are the same, and the external diameters of these are also the same. Furthermore, in this embodiment, the internal diameters of the third connection tube 92*b* and the fourth connection tube 93*b* are the same, and the external diameters of these are also the same. Accordingly, in this embodiment, the ratio of the amount of liquid flowing into the first channel portion 81 to the amount of liquid flowing into the second channel portion 82 is defined according to the difference in the internal diameter between the first introduction port 92 and the second introduction port 93 provided in the spacer member 90. Therefore, members of the first channel portion 81 and the second channel portion 82 can be used in common. In addition, members of the first channel portion 81 and the second channel portion 82 can be used in common, and thus it is possible to prevent the first channel portion 81 and the second channel portion 82 from being attached in a reversed manner. Note that in another embodiment, the internal diameters of the first channel portion 81 and the second channel portion 82 may be different, and the external diameters of these may also be different. In addition, the internal diameters of the third connection tube 92*b* and the fourth connection tube 93*b* may be different, and the external diameters of these may also be different.

Figure 19:
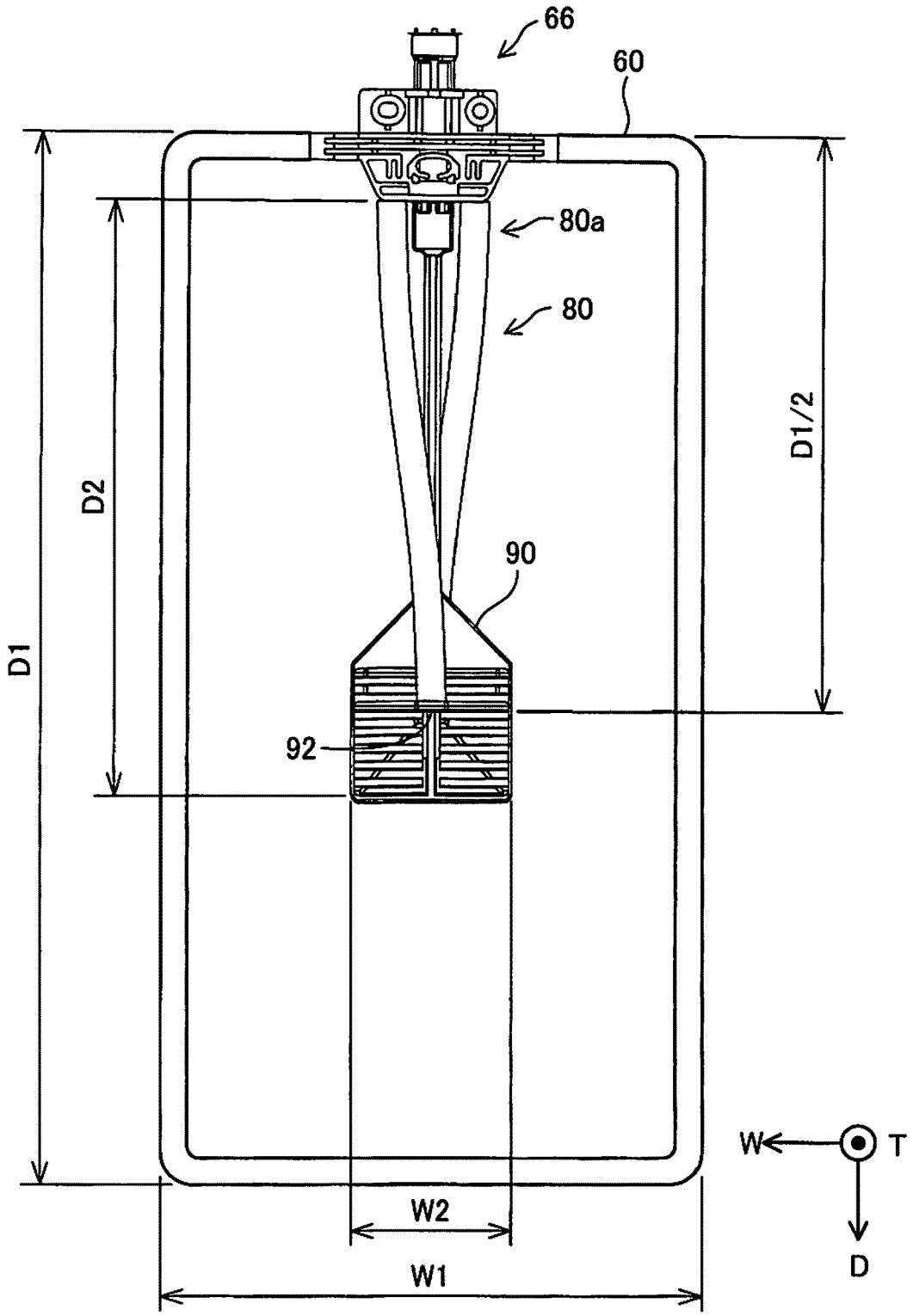
FIG. 19 is an explanatory view of the dimensions of a bag.

FIG. 19 is an explanatory view of the size of the bag 60. In this embodiment, the difference between a width W1 in the W direction of the bag 60 and a width W2 in the W direction of the spacer member 90 is preferably 300 mm or less. The width W2 is preferably 30% of the width W1 or less. Also, the difference between a dimension D1 in the D direction of the bag 60 and a dimension D2 from the base end portion 80*a* of the liquid outlet tube 80 to the end portion in the +D direction of the spacer member 90 is preferably 120 mm or less. The dimension D2 is preferably in a range of ⅓ to ⅔ of the dimension D1. In addition, the first introduction port 92 and the second introduction port 93 provided in the spacer member 90 are preferably positioned in the range of ±20 mm from the center of the bag 60 in the D direction. With the liquid container 20 that satisfies these sizes, it is possible to more effectively suppress blocking of the channel in the liquid storage portion 60*c*, and to more effectively stabilize the concentration of liquid that is supplied to the liquid ejection apparatus 11.

Figure 20:
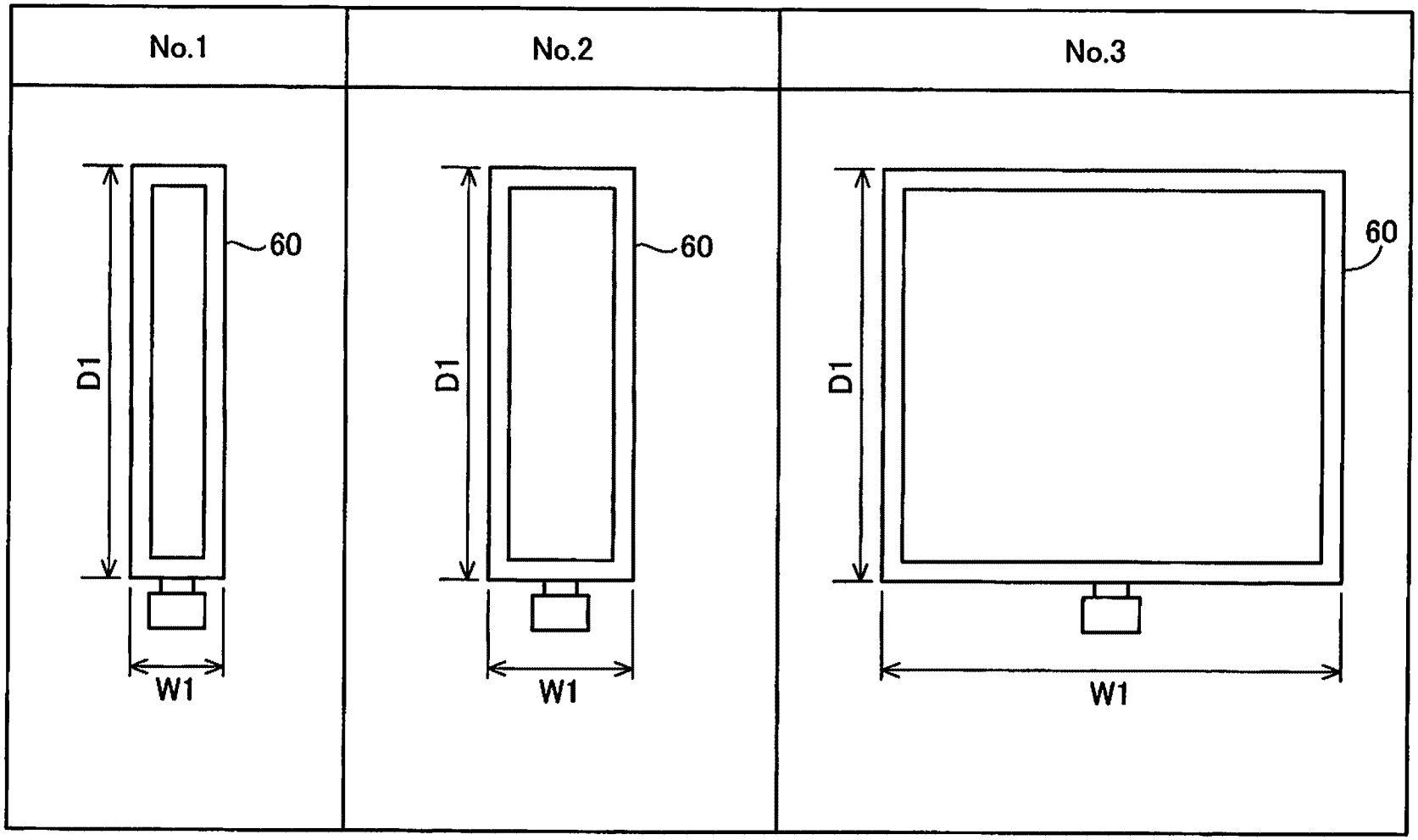
FIG. 20 is a diagram showing variations of the bag.

FIG. 20 is a diagram showing variations of the bag 60. In this embodiment, various sizes can be adopted as the width W1 in the W direction of the bag 60. For example, if the second container 13M is used, a bag indicated by No. 2 in FIG. 20 can be adopted as the bag 60. The width W1 in the W direction of this bag is 100 mm, for example. In addition, if the first container 13S is used, a bag indicated by No. 1 in FIG. 20 can be adopted as the bag 60. The width W1 in the W direction of this bag is 60 mm, for example. In addition, if a container whose width in the W direction is larger than the first container 13S and the second container 13M is used, a bag indicated by No. 3 in FIG. 20 can be adopted as the bag 60. The width in the W direction of this bag is 350 mm, for example. Accordingly, a width in the range of about 60 to 350 mm can be adopted as the width in the W direction of the bag 60. Note that all the dimensions D1 in the D direction of the bags No. 1 to 3 are about 240 mm. However, the dimensions D1 in the D direction of these bags can be suitably changed between 200 to 250 mm, for example.

Figure 21:
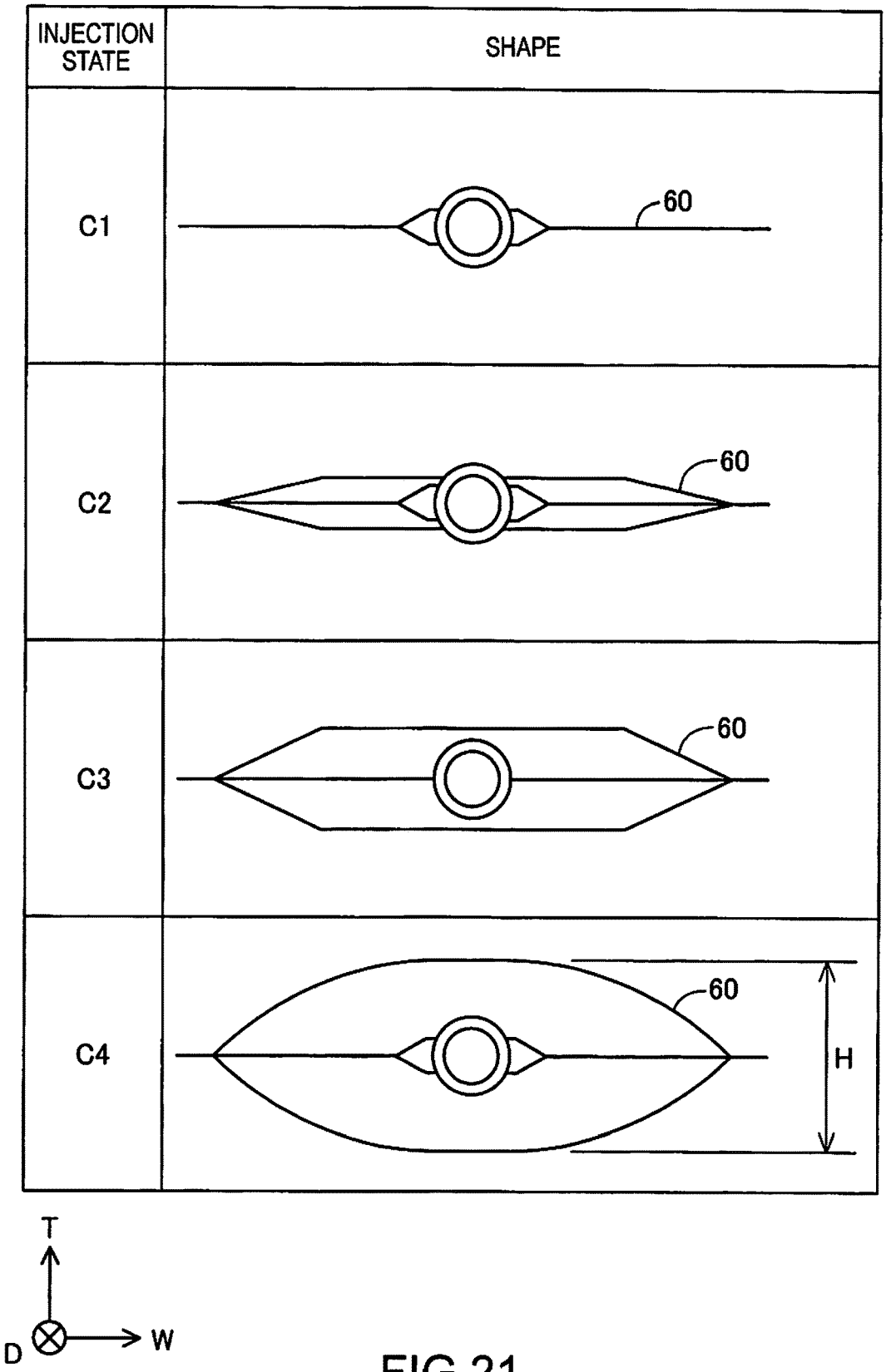
FIG. 21 is a diagram showing a change in height of the bag that is in accordance with the amount of injected liquid.

FIG. 21 is a diagram showing a change in the height of the bag 60 that corresponds to the amount of injected liquid. FIG. 21 shows a state where the spacer member 90 is not inserted into the bag 60. As shown in FIG. 21, the larger the amount of liquid that is injected into the bag 60 is, the larger the height H in the T direction of the bag 60 becomes. In FIG. 21, the amount of liquid injected into the bag 60 indicated by an injected state C1 is smallest, and the amount of liquid injected into the bag 60 indicated by an injected state C4 is largest.

Figure 22:
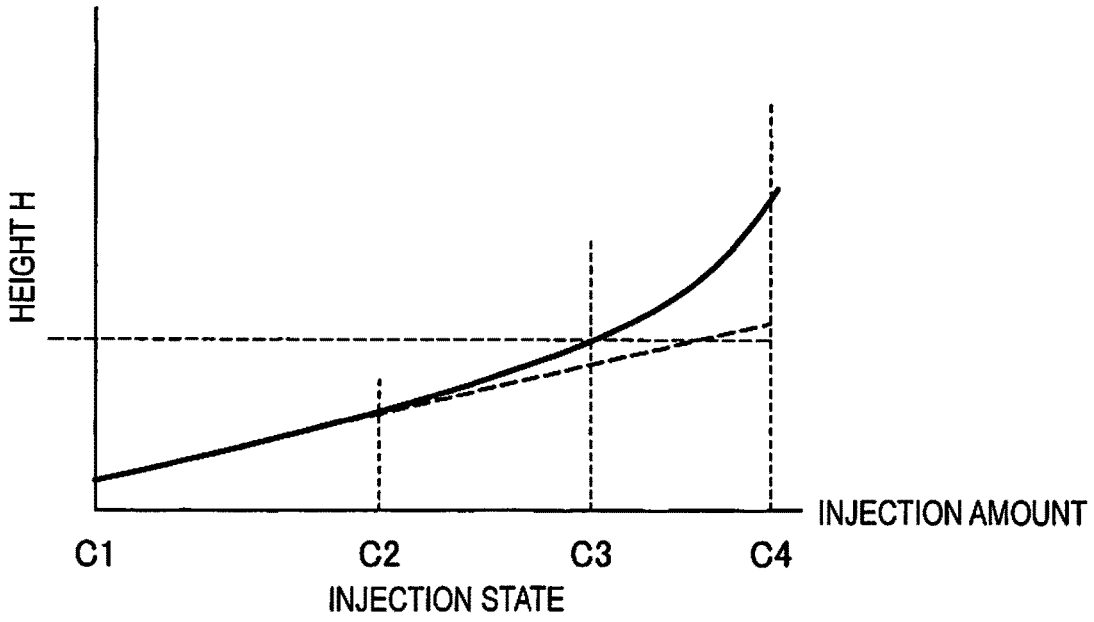
FIG. 22 is a graph showing a change in height of the bag that is in accordance with an injected state of liquid.
Figure 23:
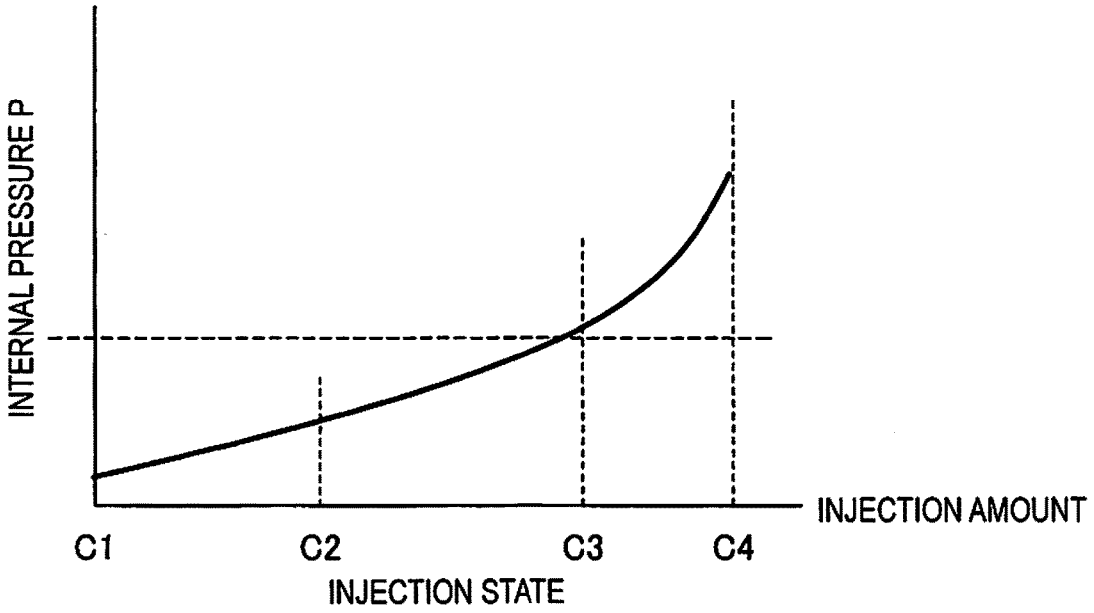
FIG. 23 is a graph showing a change in internal pressure of the bag that is in accordance with an injected state of liquid.

FIG. 22 is a graph showing change in the height H of the bag 60 that corresponds to the injected state of liquid. FIG. 23 is a graph showing a change in internal pressure P of the bag 60 that corresponds to the injected state of liquid. As shown in FIG. 22, as liquid is injected into the bag 60, the height H of the bag 60 rapidly increases from a certain injected state C3. This is because when the amount of injected liquid exceeds the injected state C3, the liquid cannot spread to the edges of the bag 60, the liquid gathers intensively at the center of the bag 60, and the height of the bag 60 increases rapidly. Also, as shown in FIG. 23, the internal pressure of the bag 60 also rapidly increases after the injected state C3. In such a state, the internal pressure P of the bag 60 rises to the water head pressure or more, and thus there is a possibility that the liquid scatters from the liquid outlet portion 52 when the liquid container 20 is mounted to the liquid ejection apparatus 11. In view of this, the maximum height of the bag 60 is preferably restricted to the height H in the injected state C3. In this embodiment, this upper limit height is set to 30 mm. Moreover, in this embodiment, the height of the spacer member 90 is also set to the same as this upper limit height. By restricting the height of the bag 60 to such a height, it is possible to suppress scattering of liquid when the liquid container 20 is mounted to the liquid ejection apparatus 11, and to suppress leakage of liquid from the welded portion of the bag 60. In addition, if the height of the bag 60 is set to such a height, as seen from the shape of the bag 60 indicated by the injected state C3 in FIG. 21, the volume efficiency for the container 13 can be improved. Note that the upper limit height of the bag 60 and the height of the spacer member 90 are preferably set constant for all the types of the bag 60 shown in FIG. 20. If the upper limit height of the bag 60 and the height of the spacer member 90 are set constant regardless of the type of the bag 60, it is possible to inhibit the concentration and the pressure of liquid, which is supplied to the liquid ejection apparatus 11, from changing according to the type of the bag 60.

Figure 24:
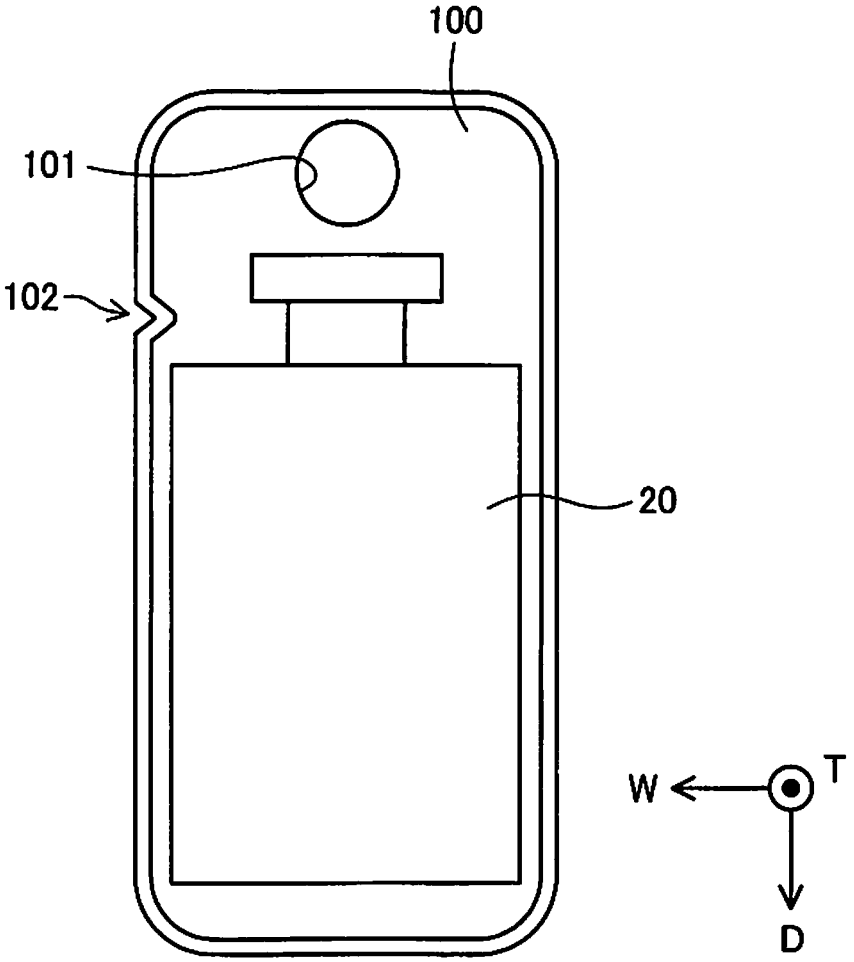
FIG. 24 is an explanatory view showing a packaged state of the liquid container.
Figure 25:
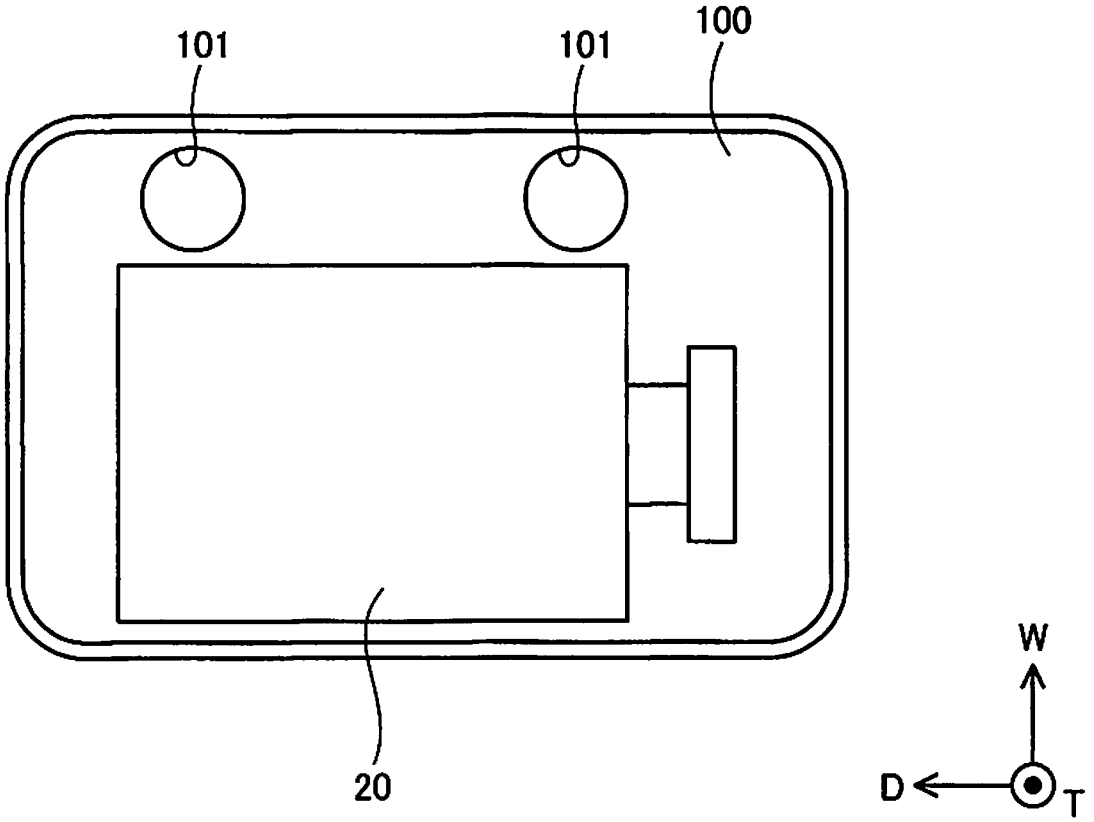
FIG. 25 is an explanatory view showing a packaged state of the liquid container.

FIGS. 24 and 25 are explanatory views showing a packaged state of the liquid container 20. The liquid container 20 is preferably transported, sold over-the-counter, or stored, in a state of being packaged in an exterior body 100 such as an exterior bag or an individual packaging box. The exterior body 100 is preferably in an orientation where the +D direction of the liquid container 20 inside thereof is set vertically downward as shown in FIG. 24, or the −W direction or the +W direction is set vertically downward as shown in FIG. 25, when the liquid container 20 is transported, sold over-the-counter, or stored. When being bought over-the-counter, the liquid container 20 can be easily brought into such an orientation by suspending the exterior body 100 using one or more suspension holes 101 provided in the exterior body 100. The shape of the suspension holes 101 is not limited to being round, and may be polygonal such as a triangle or a square.

If the exterior body 100 is in the orientation shown in FIG. 24 or 25 during transportation, over-the-counter sale or storage, when mounting the liquid container 20 to the liquid ejection apparatus 11, the orientation of the liquid container 20 is forcefully changed, and thus the liquid in the liquid container 20 is stirred, and it is possible to suppress variation in the concentration of the liquid that is led out.

Note that in this embodiment, the exterior body 100 is assumed to be suspended from the one or more suspension holes 101, and thus various modes such as round, circular, square, polygonal shapes can be used as the shape of the bottom portion of the exterior body 100. In addition, if the exterior body 100 is an exterior bag, a notch 102 (FIG. 24) for opening the exterior body 100 is preferably provided in the exterior body 100. The position of the notch 102 and the number of the notches 102 can be set as appropriate. In addition, it is preferred that the internal pressure of the exterior bag is adjusted to the atmospheric air pressure or to a decompressed state, and the exterior bag is sealed, in order to suppress leakage of the liquid in the liquid container 20 to the outside of the liquid container 20.

According to the liquid container 20 of this embodiment that has been described above, the liquid outlet tube 80 is provided in the liquid storage portion 60*c* provided in the bag 60, and thus a channel for liquid is secured around the liquid outlet tube 80, and the channel in the bag 60 is unlikely to be blocked. In addition, the end portion on the +D direction side of the liquid outlet tube 80 serves as a virtual supply port, namely, a supply port for directly supplying liquid to the liquid ejection apparatus 11, and the spacer member 90 is positioned farther than (on the +D direction side) the end portion on the +D direction side of the liquid outlet tube 80, and thus the end portion on the +D direction side of the liquid outlet tube 80 and an even farther channel are also unlikely to be blocked. Furthermore, on the spacer member 90, the inclined face 91 is provided on the far side (the +D direction side) in a direction in which liquid is suctioned, and thus the bag 60 easily collapses from the farther side (the +D direction side) to the front side (the −D direction) in accordance with the shape of the inclined face 91, and the channel on the far side of the spacer member 90 is unlikely to be blocked. Therefore, according to this embodiment, it is possible to reduce the possibility that liquid cannot be sufficiently supplied to the liquid ejection apparatus 11 due to shrinkage of the bag 60. In addition, in this embodiment, the first channel 95 and the second channel 96 are formed in the spacer member 90, and thus it is possible to more effectively suppress blocking of the channel in the liquid storage portion 60*c* due to shrinkage of the bag 60.

In addition, in this embodiment, the liquid outlet tube 80 includes the first channel portion 81 and the second channel portion 82, the first channel portion 81 suctions liquid having a low concentration, the second channel portion 82 suctions liquid having a high concentration, the liquid having a low concentration and the liquid having a high concentration can be merged at the liquid outlet portion 52, and be then supplied to the liquid ejection apparatus 11, and thus the concentration of liquid that is supplied to the liquid ejection apparatus 11 can be further stabilized.

In addition, in this embodiment, in the mounted orientation, at least one of the lowermost portion of the spacer member 90 and the uppermost portion of the spacer member 90 is in contact with the internal face of the bag 60, and thus the bag 60 is likely to shrink from the contact portion with the spacer member 90 along the shape of the inclined face 91 of the spacer member 90, and it is possible to more effectively suppress blocking of the channel in the liquid storage portion 60*c*.

In addition, in this embodiment, the first introduction port 92 of the spacer member 90 is connected to the first leading end portion 81*b* of the first channel portion 81, and the second introduction port 93 of the spacer member 90 is connected to the second leading end portion 82*b* of the second channel portion 82. In addition, in the mounted orientation, both the lowermost portion of the spacer member 90 and the uppermost portion of the spacer member 90 are in contact with the internal face of the bag 60. Therefore, the height of the bag 60 can be made constant regardless of the capacity of the bag 60, and thus it is possible to inhibit the bag 60 from being mounted to the liquid ejection apparatus 11 at different inclinations for each liquid container 20. In addition, according to such a configuration, the spacer member 90 is unlikely to move in the up-down direction, and thus from a state where liquid is not consumed to a state where the amount of liquid is small and the liquid cannot be supplied to the bag 60, the positions in the up-down direction of the first introduction port 92 and the second introduction port 93 are unlikely to change. Furthermore, liquid can be suctioned from two predetermined positions regardless of the capacity of the bag 60. As a result, the concentration of liquid that is supplied to the liquid ejection apparatus 11 can be further stabilized.

In addition, in this embodiment, in the mounted orientation, the center between the height of the lowermost portion of the spacer member 90 and the height of the uppermost portion of the spacer member 90 and the height of the central axis CX of the liquid outlet portion 52 are the same, and thus the position in the up-down direction of the liquid outlet portion 52 can be stabilized. Therefore, the liquid outlet portion 52 can be easily connected to the liquid ejection apparatus 11.

In addition, in this embodiment, the first leading end portion 81*b* of the first channel portion 81 and the second leading end portion 82*b* of the second channel portion 82 are fixed to the spacer member 90. Therefore, the positions of the first leading end portion 81*b* and the second leading end portion 82*b* that serve as virtual supply ports do not change. In addition, when an impact is applied to the liquid container 20 when the liquid container is carried and dropped or the like, the liquid outlet tube 80 is unlikely to be detached from the spacer member 90. Therefore, the concentration of liquid that is supplied to the liquid ejection apparatus 11 can be further stabilized.

Moreover, in this embodiment, in the mounted orientation, the first base end portion 81*a* of the first channel portion 81 and the second base end portion 82*a* of the second channel portion 82 are aligned in the horizontal direction, and the first leading end portion 81*b* and the second leading end portion 82*b* are aligned in the vertical direction. Therefore, the first leading end portion 81*b* and the second leading end portion 82*b* are unlikely to move in the W direction, and thus liquid can be suctioned at a stable position. In addition, liquid suctioned from the first channel portion 81 and liquid suctioned from the second channel portion 82 are converted from a state of flowing side by side in the vertical direction into a state of flowing side by side in the horizontal direction, and are then mixed, and thus the concentration of liquid that is supplied to the liquid ejection apparatus 11 can be further stabilized.

In addition, in this embodiment, the spacer member 90 is fixed to the liquid outlet member 66, and thus the positional relationship between the spacer member 90 and the liquid outlet member 66 can be stabilized. Therefore, it is possible to reduce the possibility that the concentration of liquid that is supplied to the liquid ejection apparatus 11 will vary according to individual liquid storage bodies 20.

In addition, in this embodiment, the second channel 96 for circulating liquid in a direction intersecting the D direction is formed in the spacer member 90, and thus liquid is easily suctioned also from a direction other than the D direction. Therefore, when the concentration of liquid differs in a direction other than the D direction, the concentration of liquid that is supplied to the liquid ejection apparatus 11 can be further stabilized.

In addition, in this embodiment, the partition portion 97 is provided on the spacer member 90, and the partition portion 97 is provided at a position between the first leading end portion 81*b* of the first channel portion 81 and the second leading end portion 82*b* of the second channel portion 82 in the T direction, and thus liquid having a low concentration on the upper side in the liquid storage portion 60*c* and liquid having a high concentration on the lower side are unlikely to be mixed in the vicinity of the first leading end portion 81*b* and the second leading end portion 82*b*. Therefore, it is possible to inhibit the liquid having a high concentration from being unlikely to be suctioned due to the liquid having a low concentration being suctioned from both the first leading end portion 81*b* and the second leading end portion 82*b*. As a result, the concentration of liquid that is supplied to the liquid ejection apparatus 11 can be further stabilized.

In addition, in this embodiment, a structure is adopted in which the liquid outlet member 66 cannot be erroneously mounted to the adapter 61, and furthermore, a structure is adopted in which the coupling member 85 provided on the spacer member 90 cannot be erroneously mounted to the liquid outlet member 66, and thus the first introduction port 92 and the second introduction port 93 formed in the spacer member 90 are inhibited from being arranged in a vertically inverted manner. Therefore, the concentration of liquid that is supplied to the liquid ejection apparatus 11 can be stabilized. Note that in this embodiment, the first base end portion 81*a* of the first channel portion 81 and the second base end portion 82*a* of the second channel portion 82 may be connected to the liquid outlet member 66 in a horizontally inverted manner. In other words, the first base end portion 81*a* of the first channel portion 81 may be connected to the third connection tube 92*b* of the liquid outlet member 66, and the second base end portion 82*a* may be connected to the fourth connection tube 93*b* of the liquid outlet member 66. Liquid that has flowed in from the first channel portion 81 and the second channel portion 82 has been converted from a state of flowing side by side in the vertical direction into a state of flowing side by side in the horizontal direction, and thus even if the first base end portion 81*a* of the first channel portion 81 and the second base end portion 82*a* of the second channel portion 82 are connected to the liquid outlet member 66 in a horizontally inverted manner, the capability to mix liquids does not change.

Here, variations of the arrangement and mode of the spacer member 90 will be described.

Figure 26:
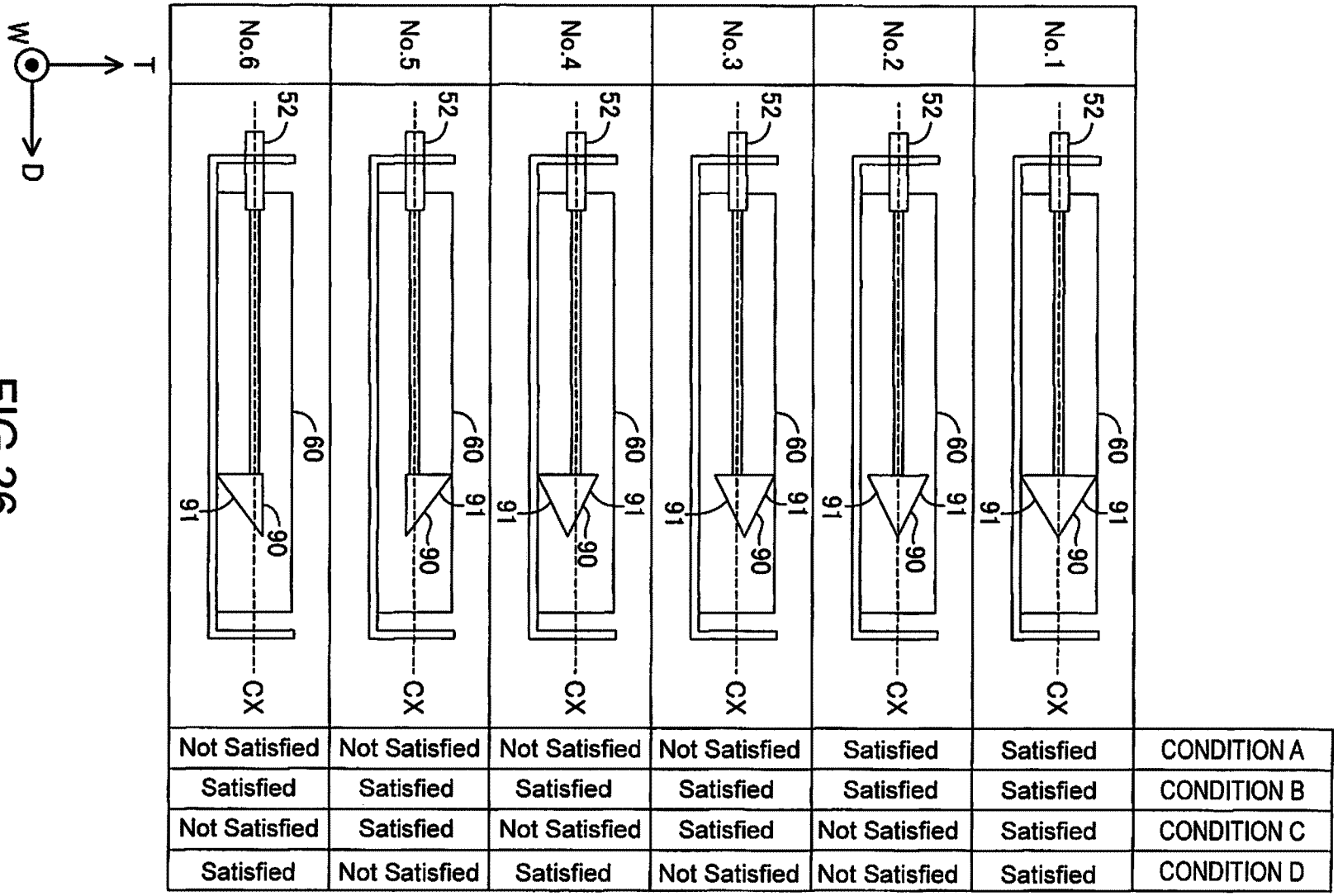
FIG. 26 is a diagram showing various aspects of the spacer member and the bag.

FIG. 26 is a diagram showing various aspects of the spacer member 90 and the bag 60 in a state where liquid is not consumed. FIG. 26 shows aspects Nos. 1 to 6 of the spacer member 90 and the bag 60. Conditions A to D shown in FIG. 26 are described as follows. Note that the numerals (No.) shown in FIG. 20 and the numerals (No.) shown in FIG. 26 are not related to each other.

Condition A: the center between the uppermost portion and the lowermost portion of the spacer member 90 coincides with the center between an upper portion and a lower portion of the liquid outlet portion 52 (the central axis CX).

Condition B: the height of the spacer member 90 (the absolute value of difference between the height of the uppermost portion and the height of the lowermost portion) is larger than the maximum diameter of the liquid outlet tube 80.

Condition C: the uppermost portion of the spacer member 90 is in contact with the internal face of the bag 60 (the internal face on the upper side).

Condition D: the lowermost portion of the spacer member 90 is in contact with the internal face of the bag 60 (the internal face on the lower side).

In the aspect No. 1, Conditions A to D are all satisfied. The aspect No. 1 is the same as the aspect of the above embodiment. Therefore, for example, the position in the up-down direction of the liquid outlet portion 52 is stabilized, and thus the liquid container 20 can be easily connected to the liquid ejection apparatus 11. In addition, the height of the bag 60 can be made constant regardless of the capacity of the bag 60, and it is possible to inhibit each bag 60 from being positioned at different inclinations. In addition, the spacer member 90 is unlikely to move in the up-down direction, and thus the concentration of liquid that is supplied to the liquid ejection apparatus 11 can be further stabilized. Furthermore, the bag 60 is likely to shrink from the contact portions with the uppermost portion and the lowermost portion of the spacer member 90 along the shape of the inclined face of the spacer member 90, and thus it is possible to more effectively suppress blocking of the channel in the liquid storage portion 60*c*.

In the aspect No. 2, Conditions A and B are satisfied, but both the uppermost portion and the lowermost portion of the spacer member 90 are not in contact with the internal face of the bag 60, and Conditions C and D are not satisfied. However, the spacer member 90 has the inclined face 91, and thus it is possible to suppress blocking of the channel in the liquid storage portion 60*c*.

In the aspect No. 3, Conditions A and D are not satisfied, but Conditions B and C are satisfied. Therefore, the bag 60 is likely to shrink from the contact portion with the uppermost portion of the spacer member 90 along the shape of the inclined face 91 of the spacer member 90, and thus it is possible to more effectively suppress blocking of the channel in the liquid storage portion 60*c*.

In the aspect No. 4, Conditions A and C are not satisfied, but Conditions B and D are satisfied. Therefore, the bag 60 is likely to shrink from the contact portion with the lowermost portion of the spacer member 90 along the shape of the inclined face 91 of the spacer member 90, and thus it is possible to more effectively suppress blocking of the channel in the liquid storage portion 60*c*.

In the aspect No. 5, the lower inclined face 91 of the spacer member 90 is omitted, and thus Conditions A and D are not satisfied, but Conditions B and C are satisfied. Therefore, the bag 60 is likely to shrink from the contact portion with the uppermost portion of the spacer member 90 along the shape of the inclined face 91 of the spacer member 90, and thus it is possible to more effectively suppress blocking of the channel in the liquid storage portion 60*c*.

In the aspect No. 6, the upper inclined face 91 of the spacer member 90 is omitted, and thus although Conditions A and C are not satisfied, Conditions B and D are satisfied. Therefore, the bag 60 is likely to shrink from the contact portion with the lowermost portion of the spacer member 90 along the shape of the inclined face 91 of the spacer member 90, and thus it is possible to more effectively suppress blocking of the channel in the liquid storage portion 60*c*.

B. Second Embodiment

Figure 27:
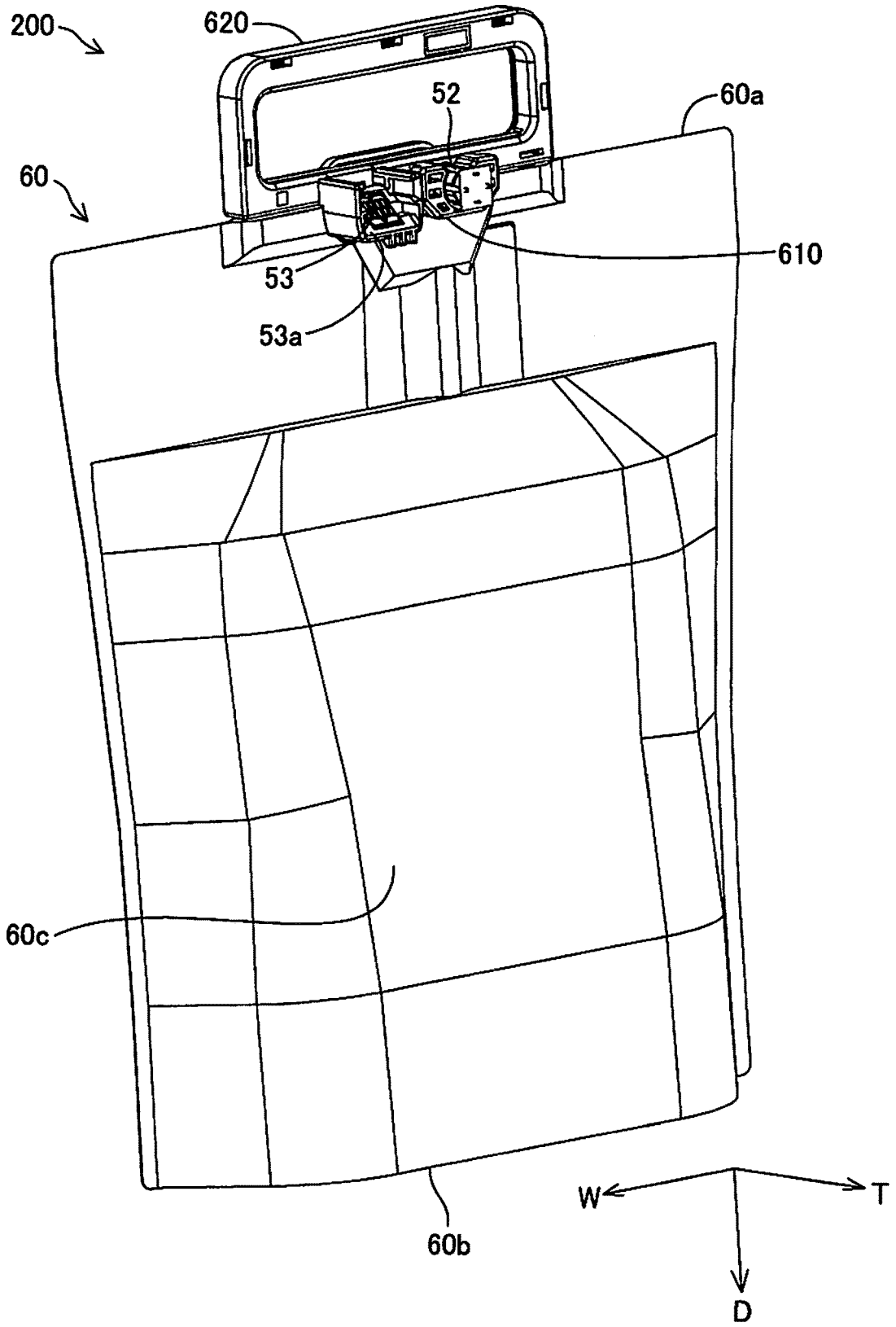
FIG. 27 is an external view of a liquid container in a second embodiment.
Figure 29:
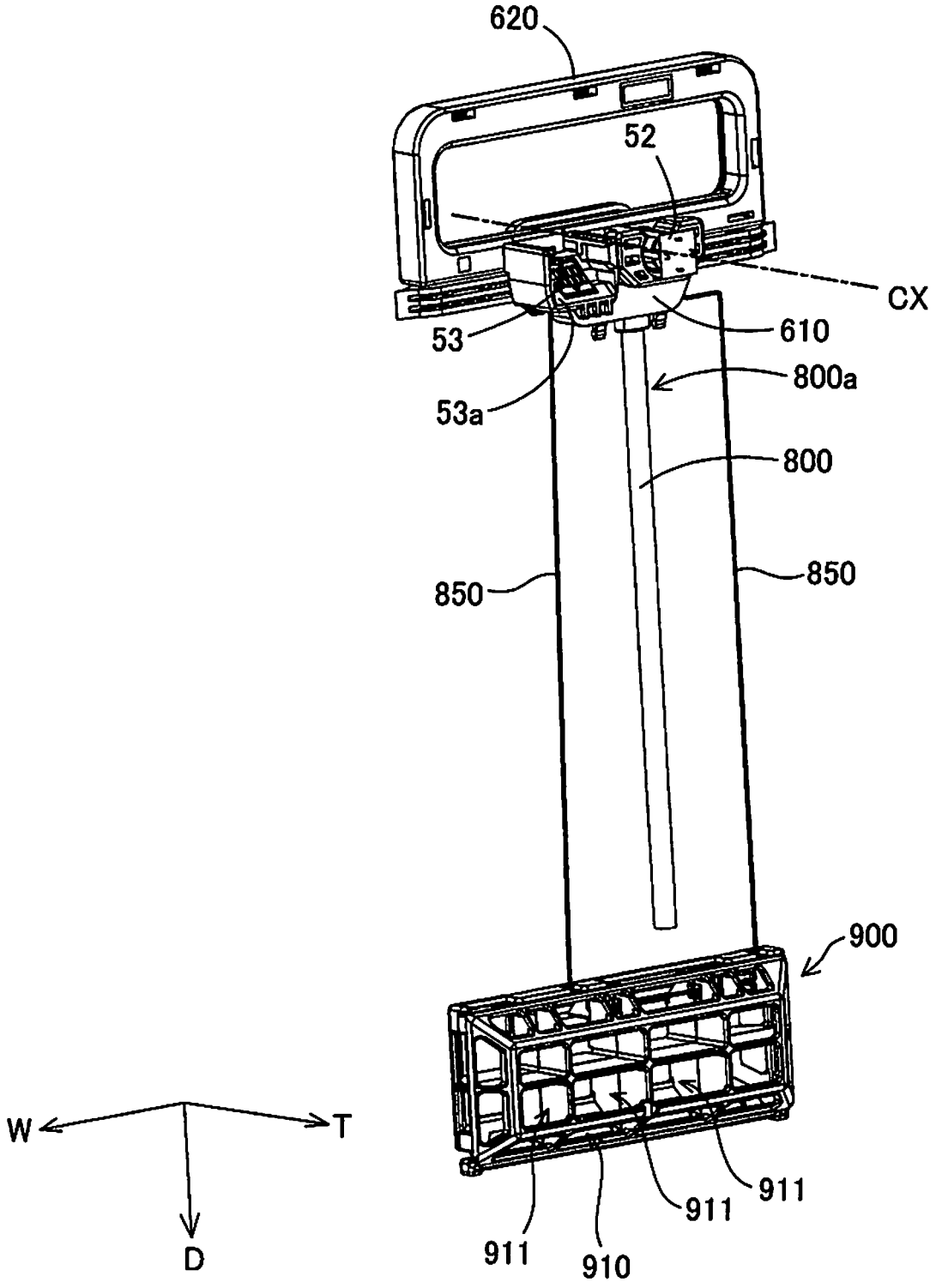
FIG. 29 is a diagram showing a spacer member and a liquid outlet tube.

FIG. 27 is an external view of a liquid container 200 in a second embodiment. A major difference between the liquid container 20 in the first embodiment and the liquid container 200 in the second embodiment is the mount orientation of a liquid container in a liquid ejection apparatus. In the following description, the same reference numerals are assigned to the constituent elements similar to those in the first embodiment, and description thereof is omitted. The liquid container 200 is mainly provided with a bag 60, a liquid outlet member 610, and a handle portion 620. In addition, a liquid outlet tube 800 and a spacer member 900 are provided in the bag 60 (FIG. 29). Note that in this embodiment, the handle portion 620 is unmovably fixed to the liquid outlet member 610.

Figure 28:
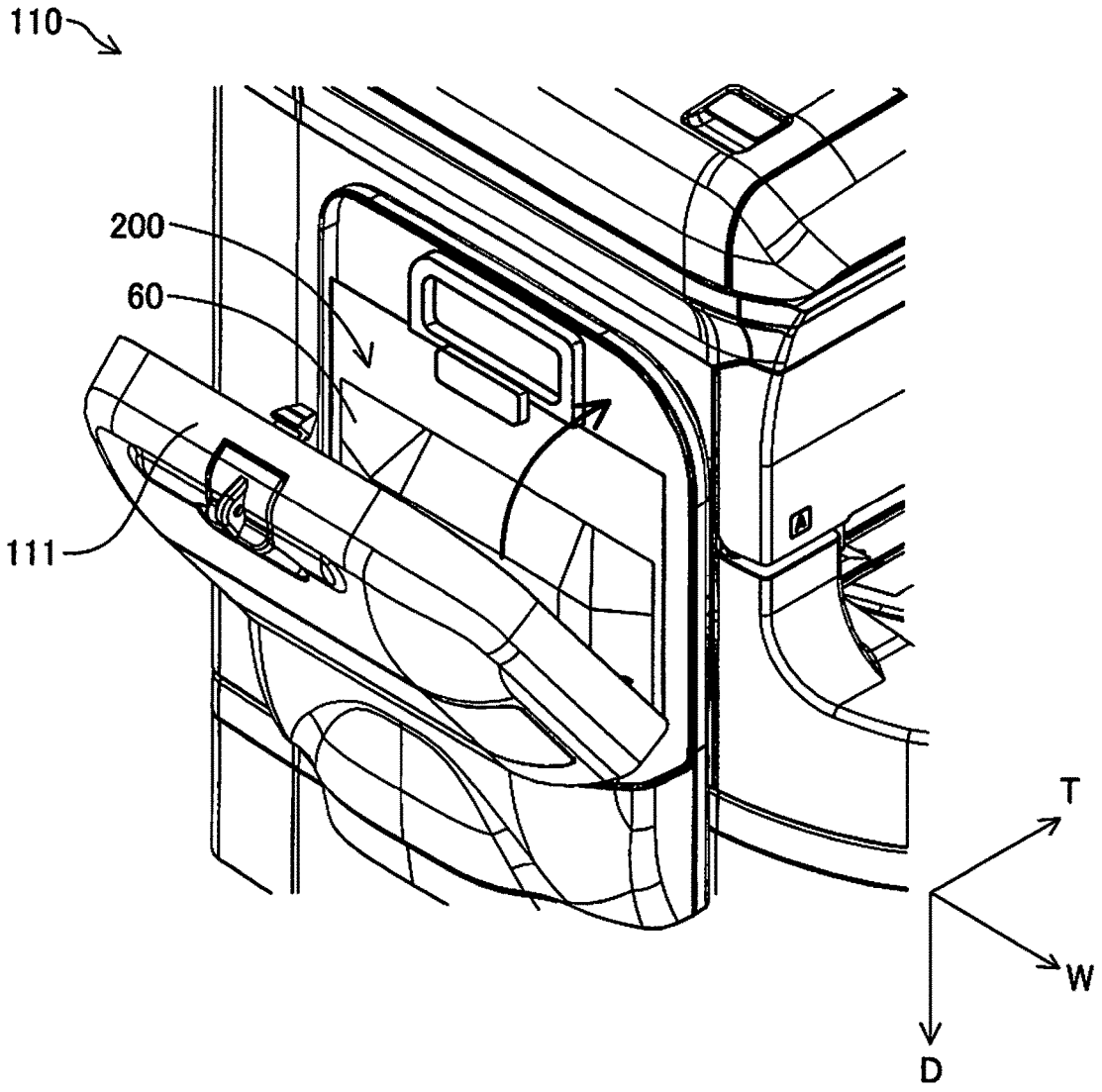
FIG. 28 is a diagram showing an orientation in which the liquid container is mounted in the liquid ejection apparatus.

FIG. 28 is a diagram showing a mount orientation of the liquid container 200 in a liquid ejection apparatus 110. The liquid container 20 of the first embodiment is placed on the container 13 such that the D direction of the bag 60 lies along the horizontal direction, and the container 13 is mounted in the liquid ejection apparatus 11. On the other hand, the liquid container 200 of the second embodiment is mounted in the liquid ejection apparatus 110 without using the container 13, such that the +D direction of the bag 60 is directed vertically downward. Therefore, in this embodiment, as shown in FIG. 27, in the orientation in which the liquid container 200 is mounted in the liquid ejection apparatus 110, a liquid outlet portion 52 provided in the liquid outlet member 610 and a recessed portion 53*a* in which a connection terminal 53 is arranged are directed in the T direction, which is perpendicular to the D direction, so as to face the liquid ejection apparatus 110 opposing them in the horizontal direction. Note that the liquid container 200 mounted in the liquid ejection apparatus 110 is covered by a cover 111 (FIG. 28) provided on the liquid ejection apparatus 110, from a side face.

FIG. 29 is a diagram showing the spacer member 900 and the liquid outlet tube 800 that are arranged in the bag 60. In the second embodiment, the number of liquid outlet tubes 800 is one. A base end portion 800*a* of the liquid outlet tube 800 is connected to the liquid outlet member 610. The liquid outlet tube 800 extends from the liquid outlet member 610 toward the other edge portion 60*b* of the bag 60 (FIG. 27). Specifically, in this embodiment, the liquid outlet tube 800 is configured to extend from the liquid outlet member 610 toward the inside of a liquid storage portion 60*c* on the gravity direction side in the orientation where the liquid container 200 is mounted in the liquid ejection apparatus 110. In this embodiment, the liquid outlet tube 800 is not connected to the spacer member 900, and liquid is directly suctioned from the end portion on the +D direction of the liquid outlet tube 800.

The spacer member 900 has a portion positioned on the +D direction side relative to the liquid outlet tube 800. Specifically, in the orientation where the liquid container 200 is mounted in the liquid ejection apparatus 110, the spacer member 900 has a portion that is positioned below the liquid outlet tube 800. In this embodiment, the spacer member 900 is fixed to the liquid outlet member 610 by two bar-like coupling members 850. In addition, the spacer member 900 is provided at a position intersecting the TD plane that includes a central axis CX of the liquid outlet portion 52. In addition, also in this embodiment, the spacer member 900 has, on the +D direction side thereof, an inclined face 910 that is inclined such that the dimension in the T direction of the spacer member 900 increases from the +D direction side toward the −D direction side. In this embodiment, the spacer member 900 is formed as a substantially hollow basket in which a plurality of through holes 911 that pass through the spacer member 900 in the T direction are formed.

In this embodiment, when the amount of liquid in the liquid storage portion 60*c* decreases to a certain degree, the through holes 911 formed in the spacer member 900 are blocked by the bag 60 being closely attached to the outer surface of the spacer member 900. Accordingly, liquid containing a large amount of a sedimentary component that has not been suctioned from the liquid outlet tube 800 and having a high concentration can be retained in the spacer member 900.

According to the liquid container 200 of the second embodiment that has been described above, similarly to the liquid container 20 of the first embodiment, the liquid outlet tube 800 is provided in the liquid storage portion 60*c*, and thus a channel for liquid is secured around the liquid outlet tube 800, and the channel in the bag 60 is unlikely to be blocked. In addition, the leading end of the liquid outlet tube 800 serves as a virtual supply port, and the spacer member 900 is positioned on the lower side (the +D direction side) relative to the leading end of the liquid outlet tube 800, and thus the leading end of the liquid outlet tube 800 as well as a channel further below the leading end of the liquid outlet tube 800 are unlikely to be blocked. Furthermore, the inclined face 910 is positioned on the far side (the +D direction side) of the spacer member 900, and thus the bag 60 is likely to collapse from the lower side (the +D direction side) to the upper side (the −D direction) in accordance with the shape of the inclined face 910, and a channel below the spacer member 900 is also unlikely to be blocked. Therefore, according to this embodiment, it is possible to reduce the possibility that liquid in the liquid container 200 cannot be sufficiently supplied to the liquid ejection apparatus 110 due to shrinkage of the bag 60.

In addition, in this embodiment, the liquid outlet tube 800 is configured to extend from the liquid outlet member 610 toward the inside of the liquid storage portion 60*c* on the gravity direction side in the orientation where the liquid container 200 is mounted in the liquid ejection apparatus 110, and the spacer member 900 has a portion positioned below the liquid outlet tube 800 in the same orientation. Therefore, liquid contained in the liquid storage portion 60*c* and having a higher concentration is easily retained in the liquid storage portion 60*c* due to the spacer member 900. Therefore, it is possible to reduce the possibility that the concentration of liquid that is supplied to the liquid ejection apparatus 110 will be uneven. In addition, it is possible to suppress clogging of the channel in the liquid ejection apparatus 110 and a recording head caused by a liquid having a high concentration being supplied to the liquid ejection apparatus 110.

C. Third Embodiment

In a third embodiment, the configurations of a spacer member and a liquid outlet member are different from the first embodiment. Hereinafter, an assembly constituted by the spacer member, the liquid outlet member, and a liquid outlet tube is referred to a "liquid outlet unit". Note that the configuration of a liquid outlet tube 80 in the third embodiment is the same as the first embodiment.

Figure 30:
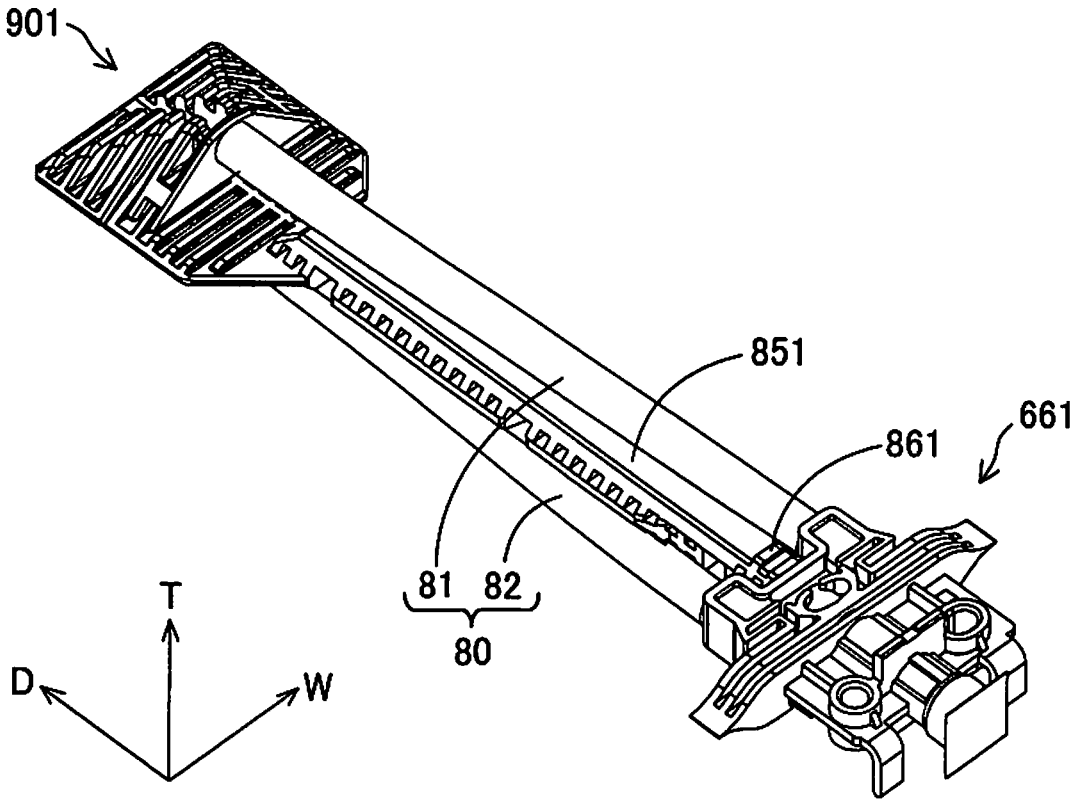
FIG. 30 is a perspective view of a liquid outlet unit in a third embodiment.
Figure 31:
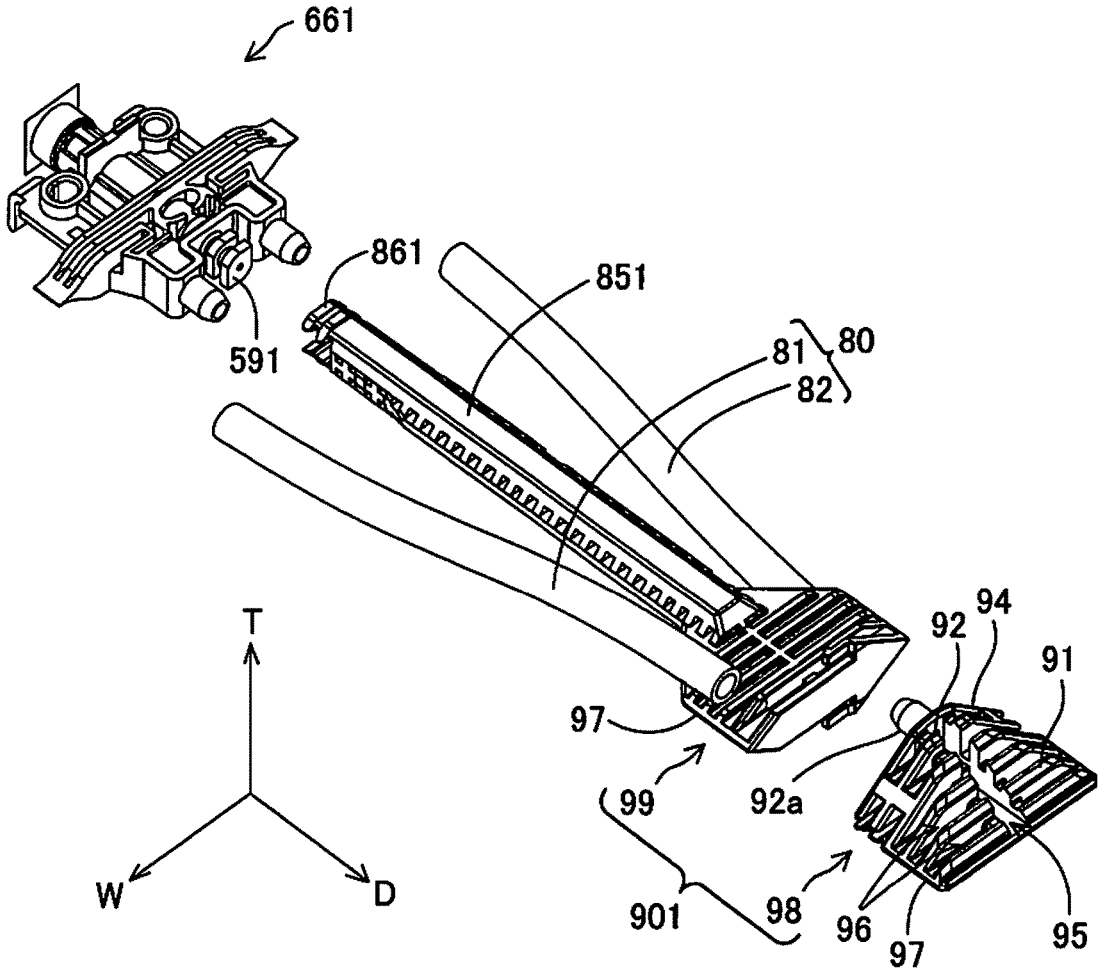
FIG. 31 is an exploded perspective view of the liquid outlet unit in the third embodiment.

FIG. 30 is a perspective view of the liquid outlet unit in the third embodiment. FIG. 31 is an exploded perspective view of the liquid outlet unit in the third embodiment. As shown in FIG. 30, the mode of the liquid outlet unit in this embodiment is substantially the same as the mode of the liquid outlet unit in the first embodiment shown in FIG. 11. However, in the third embodiment, as shown in FIG. 31, a spacer member 901 is configured to be able to be separated into a first member 98 on the +D direction side and a second member 99 on the −D direction side. Also, the second member 99 out of the first member 98 and the second member 99 is formed integrally with a coupling member 851.

The first member 98 is provided with a portion of a partition portion 97, a rear face member 94, an inclined face 91, a first introduction port 92, a first connection tube 92*a*, a second introduction port 93 (not illustrated), a second connection tube 93*a* (not illustrated), a first channel 95, and second channels 96. On the other hand, the second member 99 is provided with the remaining portion of the partition portion 97. Groove-shaped recessions and projections along the W direction are formed on the two faces of the partition portion 97 of the second member 99. The spacer member 901 has a slide-fixing mechanism for integrally fixing the first member 98 and the second member 99 by sliding the end portion in the −D direction of the first member 98 toward the end portion on the +D direction of the second member 99, and fitting the end portion in the −D direction of the first member 98 in the end portion on the +D direction of the second member 99.

The coupling member 851 in the third embodiment is thicker than the coupling member 85 in the first embodiment. The coupling members 85 and 851 are preferably rigid to the extent that the spacer members 90 and 901 do not oscillate in the liquid container 20. In addition, the coupling members 85 and 851 more preferably are rigid to the extent that the coupling members 85 and 851 do not plastically deform under the weight of the bag 60 when an adapter 61 is held, and the liquid container 20 is held horizontally. If such rigidity is secured, the positions of the spacer members 90 and 901 in the bag 60 are stabilized, and thus the channel in the bag 60 is unlikely to be blocked, and it is possible to more effectively inhibit the concentration of liquid that is supplied to the liquid ejection apparatus 11 from becoming uneven. In addition, by fixing the spacer members 90 and 901 to the liquid outlet members 66 and 661 via the bar-like coupling members 85 and 851, the positional relationship between the spacer members 90 and 901 and the liquid outlet members 66 and 661 can be further stabilized. Therefore, it is possible to more effectively reduce the possibility that the concentration of liquid that is supplied to the liquid ejection apparatus 11 varies according to the individual liquid container 20.

An engaging portion 861 for fixing the coupling member 851 to the liquid outlet member 661 is provided at the end portion on the −D direction side of the coupling member 851. The engaging portion 861 has a cylindrical shape that is open on the −D direction side and the +W direction side, and groove-shaped recessions and projections are formed on the inner periphery of the engaging portion 861. A columnar connection portion 591 that protrudes in the +D direction, and to which the engaging portion 861 of the coupling member 851 is fixed is provided near the end portion on the +D direction side of the liquid outlet member 661. Groove-shaped recessions and projections are formed on the outer periphery of the connection portion 591. In the first embodiment, by connecting, from the +D direction, the engaging portion 86 provided on the end portion on the −D direction side of the coupling member 85 with the claw portion 59 provided in the liquid outlet member 66, the spacer member 90 is fixed to the liquid outlet member 66 (see FIG. 13). On the other hand, in the third embodiment, the spacer member 901 is fixed to the liquid outlet member 661 by the engaging portion 861 of the coupling member 851 being fitted in the connection portion 591 of the liquid outlet member 661 from the lateral direction, and being rotated by 90 degrees.

Figure 32:
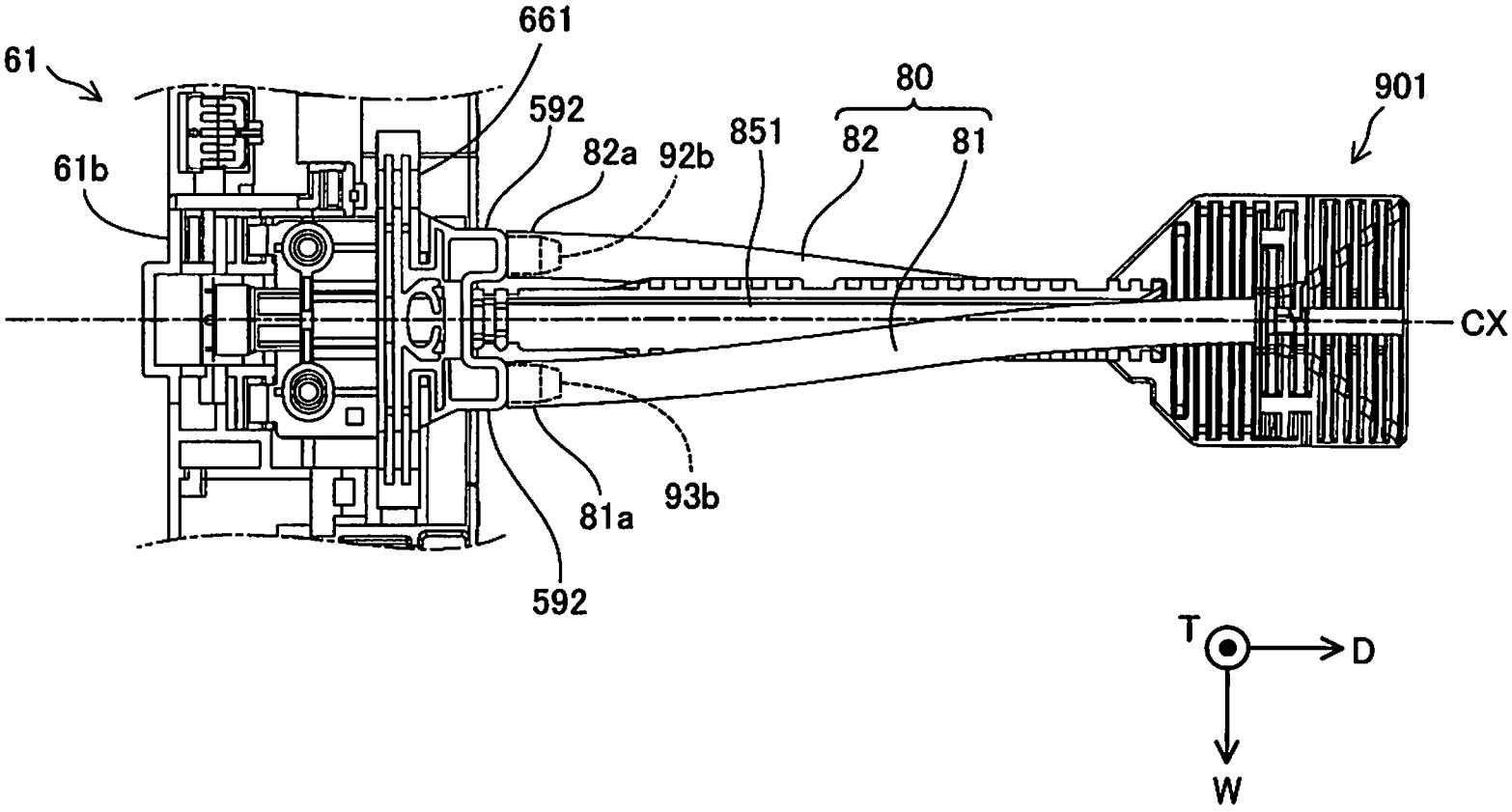
FIG. 32 is a plan view showing a state where the liquid outlet member is fixed to the bottom member of an adapter.

FIG. 32 is a plan view showing a state where the liquid outlet member 661 is fixed to a bottom member 61*b* of the adapter 61. In the first embodiment, as shown in FIG. 16, the end face in the −D direction of the liquid outlet tube 80 and the end face in the +D direction of the adapter 61 are aligned. On the other hand, in the third embodiment, as shown in FIG. 32, the end face in the −D direction of the liquid outlet tube 80 is positioned on the +D direction side relative to the end face in the +D direction of the adapter 61. Specifically, in the third embodiment, two protrusions 592 are provided at a portion of the liquid outlet member 661 to which the liquid outlet tube 80 (a first channel portion 81 and a second channel portion 82) is connected, so as to sandwich the connection portion 591 in the W direction, and to protrude in the +D direction. In addition, a fourth connection tube 93*b* to which a first base end portion 81*a* of the first channel portion 81 is connected and a third connection tube 92*b* to which a second base end portion 82*a* of the second channel portion 82 is connected are provided on the +D direction side of those protrusions 592.

Figure 33:
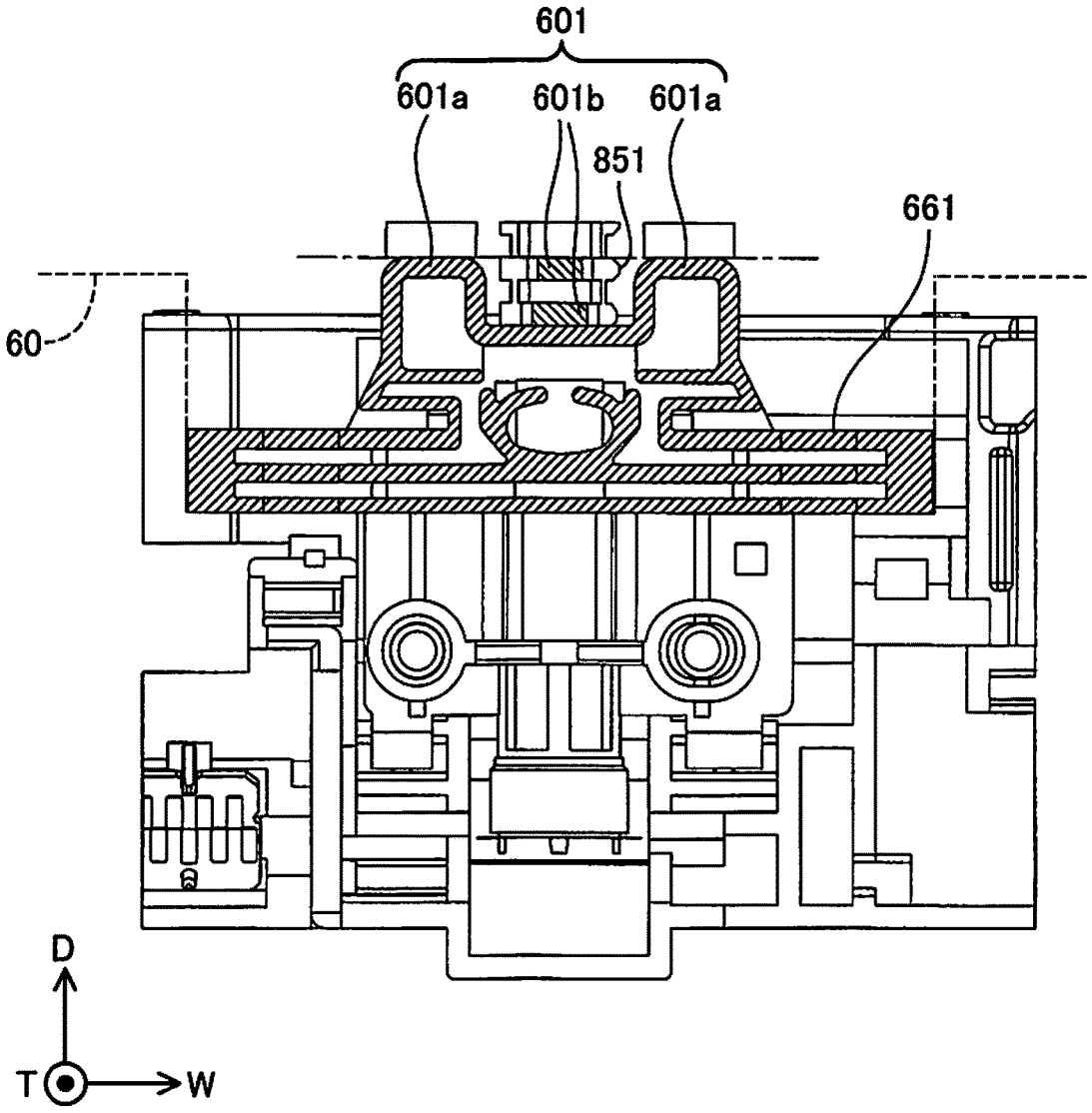
FIG. 33 is a diagram showing the position of a welded portion of the bag.
Figure 34:
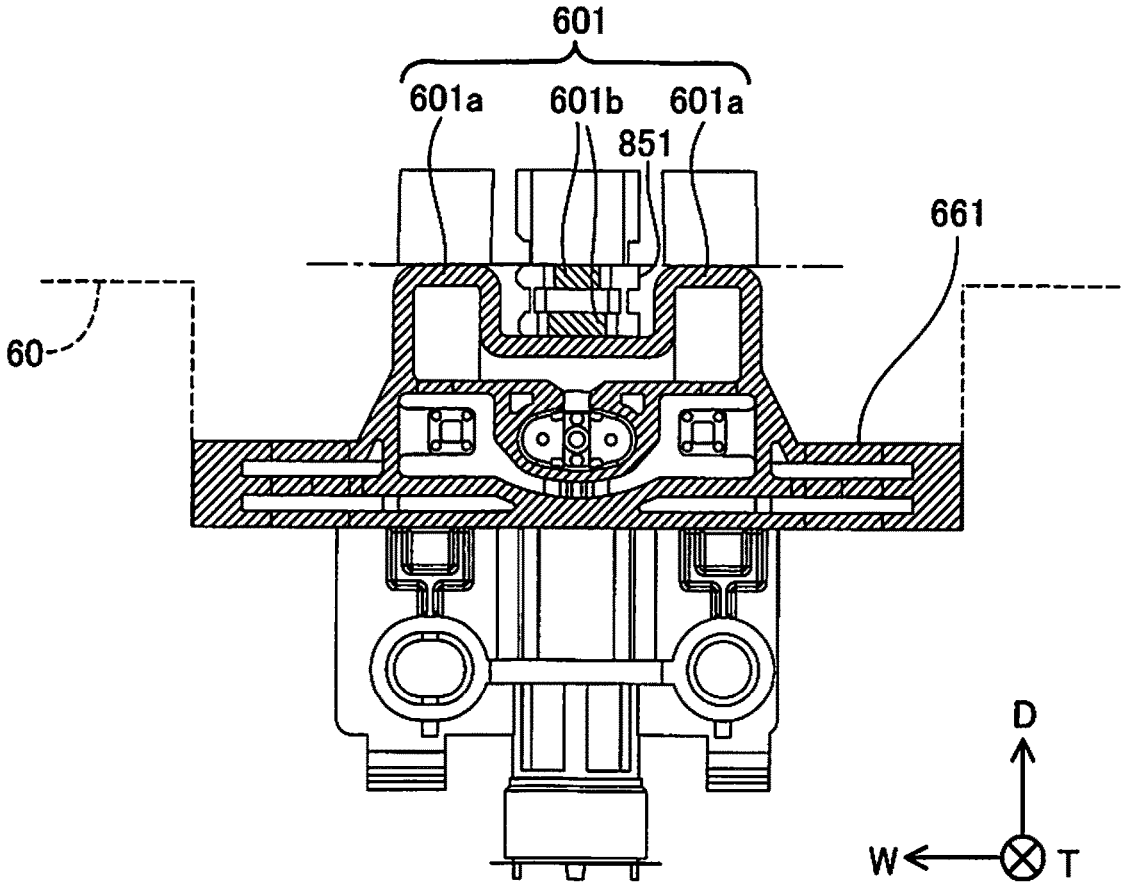
FIG. 34 is a diagram showing the position of a welded portion of the bag.

FIGS. 33 and 34 are diagrams showing the position of a welded portion 601 of the bag 60. The bag 60 has, on the −D direction side, the welded portion 601 on the bag side (hereinafter, simply referred to as a welded portion 601) welded to the liquid outlet member 661 and the coupling member 851. The welded portion 601 is provided on the internal face of an opening portion 60*d* of one edge portion 60*a* of the bag 60 (FIG. 13). In FIGS. 33 and 34, the welded portion 601 of the bag 60 is projected over the liquid outlet member 661 and the coupling member 851, and the position of the welded portion 601 is indicated by hatching. FIG. 33 shows the position of the welded portion 601 on the +T direction side, and FIG. 34 shows the position of the welded portion 601 on the −T direction side.

In this embodiment, the welded portion 601 includes a first welded portion 601*a* and a second welded portion 601*b*. The first welded portion 601*a* is a portion welded to a portion of the liquid outlet member 661. On the other hand, the second welded portion 601*b* is a portion welded to the end portion on the −D direction side of the coupling member 851 (the engaging portion 861). The first welded portion 601*a* is provided so as to sandwich the second welded portion 601*b* in the W direction. In this embodiment, the position of the farthest end on the +D direction side of the first welded portion 601*a* and the position of the farthest end on the +D direction side of the second welded portion 601*b* are aligned as indicated by a dashed-dotted line in FIGS. 33 and 34.

Figure 35:
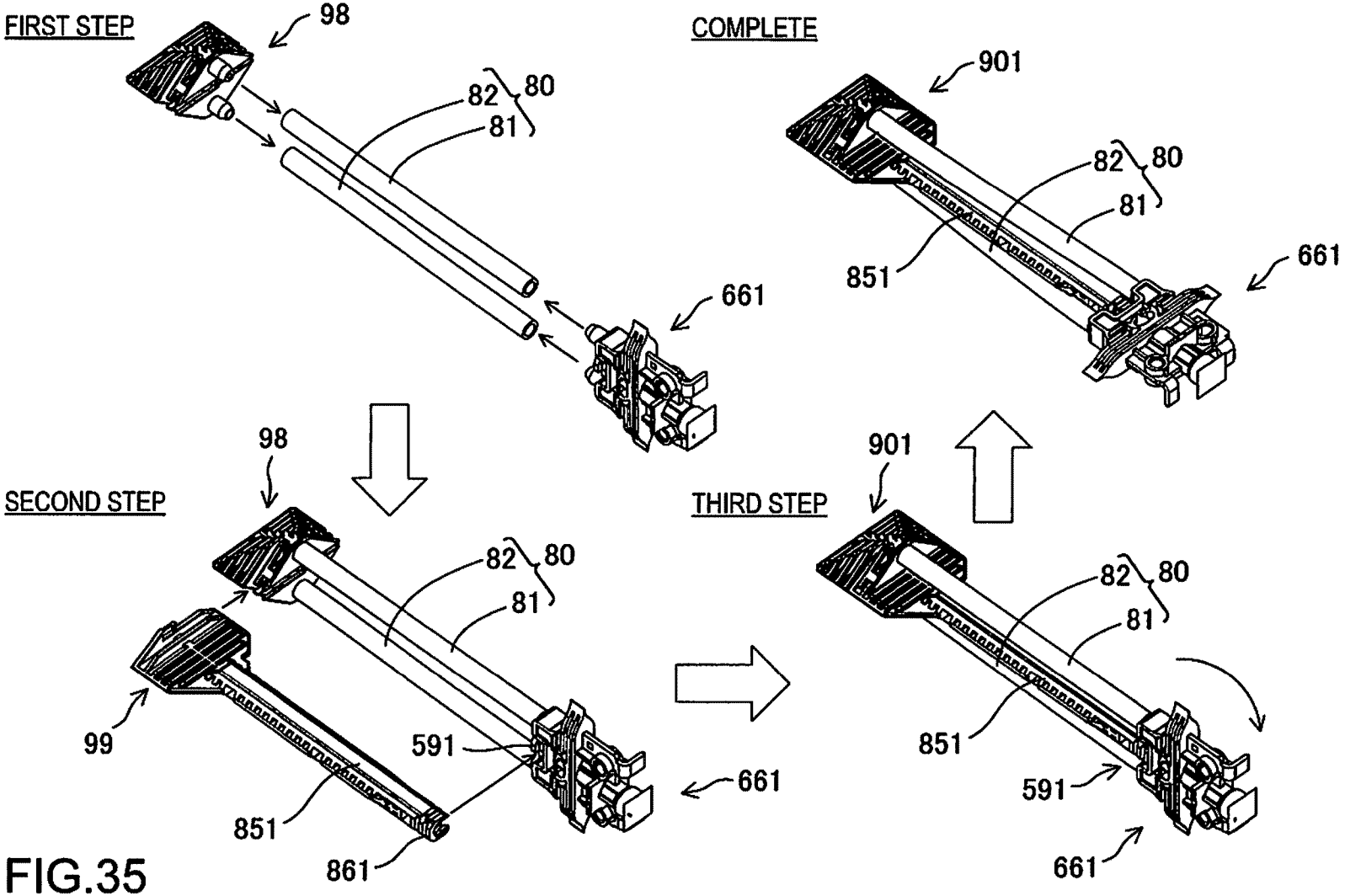
FIG. 35 is an explanatory view showing a method for assembling the liquid outlet unit.

FIG. 35 is an explanatory view showing a method for assembling the liquid outlet unit in the third embodiment. First, the first channel portion 81 and the second channel portion 82 that constitute the liquid outlet tube 80 are aligned in parallel, and the liquid outlet member 661 and the first member 98 of the spacer member 901 are respectively attached to the two ends of the liquid outlet tube 80 (first step). Subsequently, the coupling member 851 with which the second member 99 of the spacer member 901 is integrated is prepared, and while the coupling member 851 is inserted between the first channel portion 81 and the second channel portion 82, the end of the second member 99 is slid and fixed to a slide-fixing mechanism provided at the end of the first member 98, and the engaging portion 861 provided at the end of the coupling member 851 is fitted in the connection portion 591 of the liquid outlet member 661 (second step). Lastly, the liquid outlet member 661 as well as the first channel portion 81 and the second channel portion 82 are rotated centered on the connection portion 591 by 90 degrees, such that the connection portion 591 of the liquid outlet member 661 is fixed to the engaging portion 861 of the coupling member 851. By performing the above steps, the liquid outlet unit in the third embodiment is completed. In this embodiment, all of these steps can be automatized using a robot.

According to the third embodiment that has been described above, in the spacer member 901, the first member 98 that mainly functions as a spacer is configured as a constituent element different from the second member 99 integrated with the coupling member 851, and thus the shape and the size of the first member 98 can be changed as appropriate according to the size of the bag 60 and the amount of liquid that is contained in the bag 60. Therefore, the degree of freedom in design is improved.

In addition, in this embodiment, in the welded portion 601 of the bag 60, the first welded portion 601*a* is welded to the liquid outlet member 661, and the second welded portion 601*b* is welded to the coupling member 851. Accordingly, in this embodiment, the welded portion 601 of the bag 60 is welded not only to the liquid outlet member 661 but also to the coupling member 851. Therefore, the coupling member 851 is unlikely to be detached from the liquid outlet member 661, and also, it is possible to suppress peeling off of the bag 60 from the liquid outlet member 661 and the coupling member 851. Moreover, in this embodiment, the first welded portion 601*a* of the welded portion 601 of the bag 60 is provided so as to sandwich the second welded portion 601*b* in the W direction, and thus it is possible to more effectively suppress peeling off of the bag 60 from the liquid outlet member 661 and the coupling member 851. For example, when the liquid container 20 is placed in an orientation different from the orientation in a normal in-use state, or is dropped in such an orientation, there are cases where liquid is concentrated in the vicinity of the one edge portion 60*a* of the bag 60, and stress is applied to the welded portion 601. Even in such a case, according to this embodiment, the welded portion 601 of the bag 60 is welded to both the liquid outlet member 661 and the coupling member 851, and thus it is possible to suppress peeling off of the bag 60 from the welded portion 601. As a result, it is possible to suppress leakage of liquid to the outside due to peeling off of the welded portion 601. In addition, in this embodiment, in the welded portion 601 of the bag 60, the position of the farthest end on the +D direction side of the first welded portion 601*a* and the position of the farthest end on the +D direction side of the second welded portion 601*b* are aligned, and thus it is possible to more effectively suppress peeling off of the bag 60 from the liquid outlet member 661 and the coupling member 851.

Note that in this embodiment, the position of the farthest end on the +D direction side of the first welded portion 601*a* of the bag 60 and the position of the farthest end on the +D direction side of the second welded portion 601*b* are aligned, but these do not need to be aligned. In addition, in this embodiment, the first welded portion 601*a* of the bag 60 is provided so as to sandwich the second welded portion 601*b* in the W direction, but the second welded portion 601*b* does not need to be sandwiched by the first welded portion 601*a*. In addition, the welded portion 601 of the bag 60 may be welded only to the liquid outlet member 661 similarly to the first embodiment.

D. Modified Example

The invention is not limited to an inkjet printer and a liquid container for supplying ink to the inkjet printer, and can also be applied to any liquid ejection apparatus for ejecting a liquid other than ink and a liquid container used for such a liquid ejection apparatus. For example, the invention can be applied to the following various liquid ejection apparatuses and liquid storage bodies for such liquid ejection apparatuses.

(1) an image recording apparatus such as a facsimile apparatus, (2) a color material ejection apparatus used for manufacturing a color filter for an image display device such as a liquid crystal display, (3) an electrode material ejection apparatus used for forming an electrode of an organic EL (Electro Luminescence) display, a surface light emission display (Field Emission Display, FED) or the like, (4) a liquid ejection apparatus for ejecting a liquid containing a biological organic substance used for manufacturing a biochip, (5) a sample ejection apparatus as a precision pipette, (6) a lubricant oil ejection apparatus, (7) a resin liquid ejection apparatus, (8) a liquid ejection apparatus for ejecting lubricant oil onto a precision device such as a timepiece and a camera in a pin-point manner, (9) a liquid ejection apparatus for ejecting transparent resin liquid such as ultraviolet-curing resin liquid onto a substrate in order to form a microhemispherical lens (an optical lens) or the like used in an optical communication element or the like,

(10) a liquid ejection apparatus for ejecting acidic or alkaline etching liquid in order to etch a substrate or the like, and

(11) a liquid ejection apparatus provided with a liquid consumption head for discharging a very small amount of droplet of any other liquid Note that a "droplet" refers to a state of liquid discharged from a liquid ejection apparatus, and includes a granular shape, a tear-drop shape, and a shape having a thread-like trailing end. In addition, the "liquid" mentioned here may be any kind of material that can be consumed by the liquid ejection apparatus. For example, the "liquid" need only to be a material whose substance is in the liquid phase, and includes fluids such as an inorganic solvent, an organic solvent, a solution, a liquid resin, and a liquid metal (metal melt) in the form of a material in the state of liquid having a high or low viscosity, a sol, gel water, or the like. In addition, the "liquid" is not limited to being a one-state substance, and also includes particles of a functional material made from solid matter, such as pigment or metal particles, that are dissolved, dispersed, or mixed in a solvent. Representative examples of the liquid include ink such as that described in the above embodiments, liquid crystal, or the like. Here, "ink" encompasses general water-based ink and oil-based ink, as well as various types of liquid compositions such as gel ink and hot melt-ink.

The invention is not limited to the above embodiments and modified example and can be achieved as various configurations without departing from the gist of the invention. For example, the technical features in the embodiments and the modified example that correspond to the technical features in the modes described in the summary of the invention may be replaced or combined as appropriate in order to solve a part of, or the entire foregoing problem, or to achieve some or all of the above-described effects. The technical features that are not described as essential in the specification may be deleted as appropriate.

What is claimed is:

1. A liquid container for supplying a liquid containing a sedimentary component to a liquid ejection apparatus, comprising:

a flexible bag in which a liquid storage portion for containing the liquid is provided, and that has one edge portion and another edge portion opposing the one edge portion;

a liquid outlet member that is attached to the one edge portion, and has a liquid outlet portion for leading out the liquid in the liquid storage portion to the liquid ejection apparatus;

a liquid outlet tube that has a base end portion connected to the liquid outlet member, and extends in the liquid storage portion from the liquid outlet member toward the other edge portion; and a spacer member provided in the liquid storage portion, wherein when three directions orthogonal to each other are assumed to be a D direction, a T direction, and a W direction, and in the D direction, a direction from the liquid outlet portion toward the other edge portion of the bag is assumed to be a +D direction, and an opposite direction to the +D direction is assumed to be a −D direction, a direction in which a dimension of an outer shape of the liquid container is smallest is assumed to be the T direction, and a direction orthogonal to the D direction and the T direction is assumed to be the W direction, the spacer member has a portion positioned on the +D direction side relative to the liquid outlet tube, and is provided at a position intersecting a TD plane that includes a central axis of the liquid outlet portion, and lies in the T direction and the D direction, the spacer member has, on the +D direction side, a face that is inclined such that a dimension along the T direction of the spacer member increases from the +D direction side toward the −D direction side, and the spacer member is fixed to the liquid outlet member.

2. The liquid container according to claim 1, wherein the liquid outlet tube is configured to, in an orientation in which the liquid container is mounted in the liquid ejection apparatus, extend from the liquid outlet portion in the liquid storage portion in a horizontal direction, the liquid outlet tube has a first channel portion and a second channel portion, the first channel portion having a first base end portion that is connected to the liquid outlet member and a first leading end portion for introducing the liquid in the liquid storage portion into the first channel portion, and the second channel portion having a second base end portion that is connected to the liquid outlet member and a second leading end portion for introducing the liquid in the liquid storage portion into the second channel portion, and in the orientation, the first leading end portion is positioned above the second leading end portion.

3. The liquid container according to claim 2, wherein, in the orientation, at least one of a lowermost portion of the spacer member and an uppermost portion of the spacer member is in contact with an internal face of the bag.

4. The liquid container according to claim 3, wherein the spacer member includes:

a first introduction port for introducing the liquid in the liquid storage portion into the first channel portion; and a second introduction port for introducing the liquid in the liquid storage portion into the second channel portion, the first leading end portion is connected to the first introduction port, the second leading end portion is connected to the second introduction port, and in the orientation, both the lowermost portion of the spacer member and the uppermost portion of the spacer member are in contact with the internal face of the bag.

5. The liquid container according to claim 4, wherein in the orientation, a center between a height of the lowermost portion of the spacer member and a height of the uppermost portion of the spacer member is the same as a height of a central axis of the liquid outlet portion.

6. The liquid container according to claim 2, wherein the first leading end portion and the second leading end portion are connected to the spacer member.

7. The liquid container according to claim 6, wherein, in the orientation, the first base end portion and the second base end portion are aligned in the horizontal direction, and the first leading end portion and the second leading end portion are aligned in a vertical direction.

8. The liquid container according to claim 2, wherein the spacer member is fixed to the liquid outlet member via a bar-like coupling member.

9. The liquid container according to claim 8, wherein a welded portion is provided on the −D direction side of the bag, the welded portion includes a first welded portion welded to a portion of the liquid outlet member and a second welded portion welded to an end on the −D direction side of the coupling member, and the first welded portion is provided so as to sandwich the second welded portion in the W direction.

10. The liquid container according to claim 9, wherein a position of the farthest end on the +D direction side of the first welded portion and a position of the farthest end of the +D direction side of the second welded portion are aligned.

11. The liquid container according to claim 2, wherein the spacer member includes a channel for circulating the liquid in a direction intersecting the D direction.

12. The liquid container according to claim 2, wherein the spacer member has a partition portion, and the partition portion is provided at a position between the first leading end portion and the second leading end portion in the T direction.

13. The liquid container according to claim 1, wherein the liquid outlet tube is configured to extend in a gravity direction from the liquid outlet member toward the inside of the liquid storage portion in the orientation in which the liquid container is mounted in the liquid ejection apparatus, and the spacer member has a portion positioned below the liquid outlet tube in the orientation.

14. A liquid container for supplying a liquid containing a sedimentary component to a liquid ejection apparatus, comprising:

a flexible bag in which a liquid storage portion for containing the liquid is provided, and that has one edge portion and another edge portion opposing the one edge portion;

a liquid outlet member that is attached to the one edge portion, and has a liquid outlet portion for leading out the liquid in the liquid storage portion to the liquid ejection apparatus;

a liquid outlet tube that has a base end portion connected to the liquid outlet member, and extends in the liquid storage portion from the liquid outlet member toward the other edge portion; and a spacer member provided in the liquid storage portion, wherein when three directions orthogonal to each other are assumed to be a D direction, a T direction, and a W direction, and in the D direction, a direction from the liquid outlet portion toward the other edge portion of the bag is assumed to be a +D direction, and an opposite direction to the +D direction is assumed to be a −D direction, a direction in which a dimension of an outer shape of the liquid container is smallest is assumed to be the T direction, and a direction orthogonal to the D direction and the T direction is assumed to be the W direction, the spacer member has a portion positioned on the +D direction side relative to the liquid outlet tube, and is provided at a position intersecting a TD plane that includes a central axis of the liquid outlet portion, and lies in the T direction and the D direction, the spacer member has, on the +D direction side, a face that is inclined such that a dimension along the T direction of the spacer member increases from the +D direction side toward the −D direction side, the liquid outlet tube is configured to, in an orientation in which the liquid container is mounted in the liquid ejection apparatus, extend from the liquid outlet portion in the liquid storage portion in a horizontal direction, the liquid outlet tube has a first channel portion and a second channel portion, the first channel portion having a first base end portion that is connected to the liquid outlet member and a first leading end portion for introducing the liquid in the liquid storage portion into the first channel portion, and the second channel portion having a second base end portion that is connected to the liquid outlet member and a second leading end portion for introducing the liquid in the liquid storage portion into the second channel portion, and in the orientation, the first leading end portion is positioned above the second leading end portion.

* * * * *